US007000427B2

(12) United States Patent
Mathias et al.

(10) Patent No.: US 7,000,427 B2
(45) **Date of Patent: *Feb. 21, 2006**

(54) PROCESS FOR COOLING A PRODUCT IN A HEAT EXCHANGER EMPLOYING MICROCHANNELS

(75) Inventors: James A. Mathias, Columbus, OH (US); Ravi Arora, Dublin, OH (US); Wayne W. Simmons, Dublin, OH (US); Jeffrey S. McDaniel, Columbus, OH (US); Anna Lee Tonkovich, Marysville, OH (US); William A. Krause, Houston, TX (US); Laura J. Silva, Dublin, OH (US); Dongming Qiu, Dublin, OH (US)

(73) Assignee: Velocys, Inc., Plain City, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/636,659

(22) Filed: Aug. 8, 2003

(65) Prior Publication Data

US 2004/0055329 A1 Mar. 25, 2004

Related U.S. Application Data

(63) Continuation-in-part of application No. 10/219,990, filed on Aug. 15, 2002, now Pat. No. 6,622,519.

(51) Int. Cl.
*F25J 1/00* (2006.01)

(52) U.S. Cl. ..... 62/612; 62/611; 165/165

(58) Field of Classification Search ..... 62/611, 62/612, 613; 165/165, 166, 167
See application file for complete search history.

(56) References Cited

U.S. PATENT DOCUMENTS 2,960,837 A * 11/1960 Swenson et al. ..... 62/612
2,996,891 A * 8/1961 Tung ..... 62/637
3,176,763 A 4/1965 Frohlich
3,312,073 A * 4/1967 Harmens et al. ..... 62/613
3,823,457 A 7/1974 Staas et al. ..... 27/157.3
4,128,409 A 12/1978 Bennett ..... 62/26
4,183,403 A 1/1980 Nicholson ..... 165/166
4,386,505 A 6/1983 Little ..... 62/514 R
4,392,362 A 7/1983 Little ..... 62/514 R (Continued)

FOREIGN PATENT DOCUMENTS

DE 693926 7/1940

(Continued)

OTHER PUBLICATIONS

Jiang et al.; "Thermal-hydraulic performance of small scale micro-channel and porous-media heat-exchangers"; International Journal of Heat and Mass Transfer 44 (2001) 1039-1051.*

(Continued)

*Primary Examiner*—William C. Doerrier
(74) *Attorney, Agent, or Firm*—Renner, Otto, Boisselle & Sklar, LLP

(57) ABSTRACT

This invention relates to a process for cooling or liquefying a fluid product (e.g., natural gas) in a heat exchanger, the process comprising: flowing a fluid refrigerant through a set of refrigerant microchannels in the heat exchanger; and flowing the product through a set of product microchannels in the heat exchanger, the product flowing through the product microchannels exchanging heat with the refrigerant flowing through the refrigerant microchannels, the product exiting the set of product microchannels being cooler than the product entering the set of product microchannels. The process has a wide range of applications, including liquefying natural gas.

63 Claims, 17 Drawing Sheets

U.S. PATENT DOCUMENTS

| | | | | |
|---|---|---|---|---|
| 4,434,845 | A | 3/1984 | Steeb | |
| 4,516,632 | A | 5/1985 | Swift et al. | 165/167 |
| 4,690,702 | A | 9/1987 | Paradowski et al. | 62/23 |
| 4,761,515 | A | 8/1988 | Gondouin | 585/500 |
| 5,058,665 | A | 10/1991 | Harada | 165/164 |
| 5,080,875 | A | 1/1992 | Bernauer | 423/210 |
| 5,114,450 | A | 5/1992 | Paradowski et al. | 62/24 |
| 5,271,459 | A | 12/1993 | Daschmann | 165/166 |
| 5,309,637 | A | 5/1994 | Moriarty | 29/890.054 |
| 5,317,805 | A | 6/1994 | Hoopman et al. | 29/890.03 |
| 5,324,452 | A | 6/1994 | Allam et al. | 252/373 |
| 5,518,697 | A | 5/1996 | Dalla Betta et al. | 422/173 |
| 5,590,538 | A | 1/1997 | Hus et al. | 62/51.2 |
| 5,611,214 | A | 3/1997 | Wegeng et al. | 62/498 |
| 5,674,301 | A | 10/1997 | Sakai et al. | 48/61 |
| 5,689,966 | A | 11/1997 | Zess et al. | 62/238.6 |
| 5,727,618 | A | 3/1998 | Mundinger et al. | 165/80.4 |
| 5,775,114 | A | 7/1998 | Ji | 62/121 |
| 5,791,160 | A | 8/1998 | Mandler et al. | 62/611 |
| 5,811,062 | A | 9/1998 | Wegeng et al. | 422/129 |
| 5,858,314 | A | 1/1999 | Hsu et al. | 422/211 |
| 5,911,273 | A | 6/1999 | Brenner et al. | 165/167 |
| 5,927,396 | A | 7/1999 | Damsohn et al. | 165/167 |
| 6,056,932 | A | 5/2000 | von Hippel et al. | 423/376 |
| 6,105,388 | A | 8/2000 | Acharya et al. | 62/612 |
| 6,105,389 | A | 8/2000 | Paradowski et al. | 62/613 |
| 6,126,723 | A | 10/2000 | Drost et al. | 96/4 |
| 6,129,973 | A | 10/2000 | Martin et al. | 428/166 |
| 6,159,358 | A | 12/2000 | Mulvaney, III et al. | 208/46 |
| 6,167,952 | B1 | 1/2001 | Downing | 165/167 |
| 6,192,596 | B1 | 2/2001 | Bennett et al. | 34/76 |
| 6,193,501 | B1 | 2/2001 | Masel et al. | 431/170 |
| 6,200,536 | B1 | 3/2001 | Tonkovich et al. | 422/177 |
| 6,203,587 | B1 | 3/2001 | Lesieur et al. | 48/61 |
| 6,216,343 | B1 | 4/2001 | Leland et al. | 29/890.32 |
| 6,220,497 | B1 | 4/2001 | Benz et al. | 228/118 |
| 6,228,341 | B1 | 5/2001 | Hebert et al. | 423/352 |
| 6,230,408 | B1 | 5/2001 | Ehrfeld et al. | 29/890.039 |
| 6,241,875 | B1 | 6/2001 | Gough | 208/106 |
| 6,274,101 | B1 | 8/2001 | Sechrist | 422/198 |
| 6,294,138 | B1 | 9/2001 | von Hippel et al. | 422/200 |
| 6,295,833 | B1 * | 10/2001 | Hoffart et al. | 62/613 |
| 6,298,688 | B1 | 10/2001 | Brostow et al. | 62/613 |
| 6,313,393 | B1 | 11/2001 | Drost | 136/201 |
| 6,318,913 | B1 | 11/2001 | Wakamiya et al. | 396/576 |
| 6,352,577 | B1 | 3/2002 | Martin et al. | 96/4 |
| 6,364,007 | B1 | 4/2002 | Fischer | 165/166 |
| 6,381,846 | B1 | 5/2002 | Insley et al. | 29/890.039 |
| 6,389,696 | B1 | 5/2002 | Heil et al. | 29/890.039 |
| 6,412,302 | B1 | 7/2002 | Foglietta | 62/611 |
| 6,415,860 | B1 | 7/2002 | Kelly et al. | 165/748 |
| 6,427,483 | B1 | 8/2002 | Rashad | 62/613 |
| 6,488,838 | B1 | 12/2002 | Tonkovich et al. | 208/108 |
| 6,497,856 | B1 | 12/2002 | Lomax, Jr. et al. | 423/651 |
| 6,540,975 | B1 | 4/2003 | Tonkovich et al. | 423/659 |
| 6,546,998 | B1 | 4/2003 | Oh et al. | 165/110 |
| 6,622,519 | B1 * | 9/2003 | Mathias et al. | 62/611 |
| 6,675,875 | B1 | 1/2004 | Vafai et al. | 165/80.4 |
| 6,746,819 | B1 | 6/2004 | Schmitz et al. | 430/272.1 |
| 6,747,178 | B1 | 6/2004 | Harston et al. | 570/175 |
| 6,749,814 | B1 | 6/2004 | Bergh et al. | 422/130 |
| 6,749,817 | B1 | 6/2004 | Mulvaney, III | 422/200 |
| 6,755,211 | B1 | 6/2004 | O'Connor et al. | 137/554 |
| 6,769,444 | B1 | 8/2004 | Guzman et al. | 137/15.01 |
| 6,770,245 | B1 | 8/2004 | Akporiaye et al. | 422/82.12 |
| 6,773,684 | B1 | 8/2004 | Lesieur et al. | 422/198 |
| 2001/0024629 | A1 | 9/2001 | Brauchle et al. | 422/198 |
| 2001/0025705 | A1 | 10/2001 | Nash et al. | 165/167 |
| 2001/0030041 | A1 | 10/2001 | Boneberg et al. | 165/166 |
| 2001/0051662 | A1 | 12/2001 | Arcuri et al. | 518/704 |
| 2002/0029871 | A1 | 3/2002 | Kern | 165/151 |
| 2002/0031455 | A1 | 3/2002 | Hippel et al. | 422/173 |
| 2002/0051741 | A1 | 5/2002 | Abe et al. | 422/199 |
| 2002/0071797 | A1 | 6/2002 | Loffler et al. | 422/190 |
| 2002/0081473 | A1 | 6/2002 | Hanai et al. | 429/26 |
| 2002/0106539 | A1 | 8/2002 | Chung et al. | 429/19 |
| 2002/0131907 | A1 | 9/2002 | Iwasaki | 422/110 |
| 2004/0104010 | A1 | 6/2004 | Kenny et al. | 165/80.4 |
| 2004/0123626 | A1 | 7/2004 | Caze et al. | 65/17.2 |
| 2004/0125689 | A1 | 7/2004 | Ehrfeld et al. | 366/165.1 |
| 2004/0130057 | A1 | 7/2004 | Mehrabi et al. | 264/171.13 |
| 2004/0131345 | A1 | 7/2004 | Kylberg et al. | 392/465 |
| 2004/0131507 | A1 | 7/2004 | Saitmacher et al. | 422/111 |
| 2004/0131829 | A1 | 7/2004 | Joseph et al. | 428/166 |
| 2004/0136902 | A1 | 7/2004 | Plath et al. | 423/651 |
| 2004/0141893 | A1 | 7/2004 | Martin | 422/198 |
| 2004/0143059 | A1 | 7/2004 | Cabrera | 524/800 |
| 2004/0144421 | A1 | 7/2004 | Parce et al. | 137/14 |
| 2004/0156762 | A1 | 8/2004 | Schuppich et al. | 422/191 |

FOREIGN PATENT DOCUMENTS

| | | | |
|---|---|---|---|
| DE | 196 48 902 | C2 | 10/1998 |
| EP | 0 885 086 | B1 | 2/1997 |
| EP | 1 311 341 | B1 | 8/2001 |
| EP | 0 904 608 | B1 | 12/2001 |
| FR | 2 184 536 | | 12/1973 |
| FR | 2184536 | | 12/1973 |
| WO | 97/32687 | | 9/1997 |
| WO | 98/55812 | | 10/1998 |
| WO | 00/06295 | | 10/2000 |
| WO | 00/76651 | A1 | 12/2000 |
| WO | 01/10773 | A1 | 2/2001 |
| WO | 01/12312 | A2 | 2/2001 |
| WO | 01/12753 | A1 | 2/2001 |
| WO | 01/54807 | A1 | 2/2001 |
| WO | 01/69154 | A1 | 9/2001 |
| WO | 01/95237 | A2 | 12/2001 |
| WO | 02/00547 | A1 | 3/2002 |
| WO | 02/061354 | A1 | 8/2002 |
| WO | 02/02220 | A1 | 10/2002 |
| WO | 03/026788 | | 4/2003 |
| WO | 03/078052 | A1 | 9/2003 |
| WO | 03/106386 | A2 | 12/2003 |
| WO | 2004/045760 | | 6/2004 |
| WO | 2004/050799 | | 6/2004 |
| WO | 2004/052518 | | 6/2004 |
| WO | 2004/052530 | | 6/2004 |
| WO | 2004/052941 | | 6/2004 |
| WO | 2004/054013 | | 6/2004 |
| WO | 2004/054696 | | 7/2004 |
| WO | 2004/062790 | | 7/2004 |
| WO | 2004/062791 | | 7/2004 |
| WO | 2004/062792 | | 7/2004 |
| WO | 2004/067160 | | 8/2004 |
| WO | 2004/067447 | | 8/2004 |
| WO | 2004/067708 | | 8/2004 |

OTHER PUBLICATIONS

1997 Ashrae Fundamentals Handbook; pp. 1.4-1.14.

Kelly et al.; "Industrial applications for LIGA-fabricated micro heat exchangers"; MEMS Components and Applications for Industry, Automobiles, Aerospace and Communication, Proceedings of SPIE, Vo. 4559 (2001), pp. 73-84.

Mezzo Systems, Inc., "Innovative Technologies for Mass Production of Microstructures."

Haynes et al.; "High-Effectiveness Micro-Exchanger Performance"; 2002 Heatric (a division of Meggitt (UK) Ltd); Prepared for presentation at the AiChE 2002 Spring National Meeting, Mar. 10-14, 2002.

Patel et al.; Design, Construction and Performance of Plastic Heat Exchangers for Sub-Kelvin Use; Cryogenics 40 (2000) 91-98.
El-Dessouky et al.; "Plastic/compact heat exchangers for single-effect desalination systems"; Desalination 122 (1999) 271-289.
Munkejord et al.; "Micro technology in heat pumping systems"; International Journal of Refrigeration 25 (2002) 471-478.
International Search Report, Application No. PCT/US03/24903, dated Dec. 23, 2003.
Brouwers; "Heat transfer, condensation and fog formation in crossflow plastic heat exchangers"; Int. J. Heat Mass Transfer; vol. 39, No. 2, pp. 391-405; 1996.
Haack et al.; "Novel Lightweight Metal Foam Heat Exchangers"; Provair Fuel Cell Technology, Inc., and University of Cambridge.
Fischer; "A New Process to Reduce LNG Cost"; Prepared for presentation at AICHE Spring National Meeting; Mar. 10-14, 2002.
Quadir et al.; "Analysis of microchannel heat exchangers using FEM"; International Journal of Numerical Methods for Heat & Fluid Flow; vol. 11, No. 1; 2002; pp. 59-75.
Genssle et al.; "Analysis of the process characteristics of an absorption heat transfomer with compact heat exchangers and the mixture TFE-E181"; Int. J. Therm. Sci. (2000) 39, 30-38.
Nasrifar et al.; "A saturated liquid density equation in conjunction with the Predicitve-Soave-Redlich-Kwong equation of state for pure refrigerants and LNG multicomponent systems"; Fluid Phase Equilibria 153 (1998) 231-242.
Miller et al.; "Experimental Molar Volumes for Some LNG-Related Saturated Liquid Mixtures"; Fluid Phase Equilibria, 2 (1978) 49-57.
Rachkovskij et al.; "Heat exchange in short microtubes and micro heat exchangers with low hydraulic losses"; Microsystem Technologies 4 (1998) 151-158.
Jiang et al.; "Thermal-hydraulic performance of small scale micro-channel and porous-media heat-exchangers"; International Journal of Heat and Mass Transfer 44 (2001) 1039-1051.
Ehlers et al.; "Mixing in the offstream of a microchannel system"; Chemical Engineering and Processing 39 (2000) 291-298.
Bach et al.; "Spiral Wound Heat Exchangers for LNG Baseload Plants"; Linde AG, Process and Engineering and Contracting Division (Linde); PS5-1.1—PS5 1.13.
Zhao et al.; "Microchannel Heat Exchangers with Carbon Dioxide"; Center for Environmental Energy Engineering, Department of Mechanical Engineering, University of Maryland; Prepared for the Air-Conditioning and Refrigeration Technology Institute; Sep., 2001.
Sekulic et al.; "Thermal Design Theory of Three-Fluid Heat Exchangers"; Advances in Heat Transfer, vol. 26; pp. 219-328; 1995.
Suessman et al.; "Passage Arrangements in Plate-Fin Exchangers"; Proceedings of XV International Congress of Refrigeration; vol. 1, pp. 421-429 (1979).
Paffenbarger; "General Computer Analysis of Multistream, Plate-Fin Heat Exchangers"; Compact Heat Exchangers—A Festschrift for A. L. London, Hemisphere, pp. 727-746 (1990).
Schack et al.; "Industrial Heat Transfer"; Heat Exchangers Without Storage (Recuperators); John Wiley & Sons, Inc., New York, 1933; pp. 208-237.
Prasad; "Fin efficiency and mechanisms of heat exchange through fins in multi-stream plate-fin heat exchangers: formulation"; Int. J. Heat Mass Transfer; vol. 39, No. 2, pp. 419-428; 1996.
Prasad et al.; "Differential Methods for the Performance Prediction of Multistream Plate-Fin Heat Exchangers"; Journal of Heat Transfer; Feb. 1992, vol. 114, pp. 41-49.
Kim et al.; "Development of a microchannel evaporator model for a CO2 air-conditioning system"; Energy 26 (2001) 931-948.
Jiao et al.; "Experimental investigation of header configuration on flow maldistribution in plate-fin heat exchanger"; Applied Thermal Engineering 23 (2003) 1235-1246.
Ranganayakulu et al.; "The effects of inlet fluid flow nonuniformity on thermal performance and pressure drops in crossflow plate-fin compact heat exchangers"; Int. J. Heat Mass Transfer, vol. 40, No. 1, pp. 27-38; 1997.
Ranganayakulu et al.; "The combined effects of wall longitudinal heat conduction, inlet fluid flow nonuniformity and temperature nonuniformity in compact tube-fin heat exchangers; a finite element method"; International Journal of Heat and Mass Transfer 42 (1999) 263-273.
Venkatarathnam et al.; "Performance of a counter flow heat exchanger with longitudinal heat conducion through the wall separating the fluid streams from the environment"; Cryogenics 39 (1999) 811-819.
Boman et al.; "Design and Manufacture of ultra-low mass, cryogenic heat exchangers"; Cryogenics 41 (2002) 797-803.
Aganda et al.; "Airflow maldistribution and the performance of a packaged air conditioning unit evaporator"; Applied Thermal Engineering 20 (2000) 515-528.
Kim et al.; "Development of a microchannel evaporator model for a CO2 air-conditioning system"; Engergy 26 (2001) 931-948.
Murray et al.; "Overview of the Development of Heat Exchangers for Use in Air-Breathing Propulsion Pre-Coolers"; Acta Astronautica, vol. 41, No. 11, pp. 723-729; 1997.
Bier et al.; "Gas to gas heat transfer in micro heat exchangers"; Chemical Engineering and Processing, 32 (1993) 33-43.
Stief et al.; "Numerical Investigations and Optimal Heat Conductivity in Micro Heat Exchangers"; DECHEMA Society for Chemical Engineering and Biotechnology; Prepared for presentation at AIChE 2000 Spring National meeting (Mar. 5-9, 2000).
Chong et al.; "Optimisation of single and double layer counter flow microchannel het stinks"; Applied Thermal Engineering 22 (2002) 1569-1585.
Aganda et al.; "A comparison of the predicted and experimental heat transfer performance of a finned tube evaporator"; Applied Thermal Engineering 20 (2000) 499-513.
Lin et al.; "Prospects of confined flow boiling in thermal management of microsystems"; Applied Thermal Engineering 22 (2002) 825-837.
Prasad et al.; "Differential method for sizing multistream plate fin heat exchangers"; Cryogenics 1987, vol. 27, May, pp. 257-262.
Prasad; "The Performance Prediction of Multistream Plate-Fin Heat Exchangers Based on Stacking Pattern"; Heat Transfer Engineering, vol. 12, No. 4, 1991, pp. 58-70.

V.V. Wadekar; "Compact heat exchangers (CHEs) offer high heat-transfer coefficients and large surface areas with a small footprint, making them a cost-effective alternative to shell-and-tube exchangers in many applications"; American Institute of Chemical Engineers; 2000; pp. 39-49, www.aiche.org/cep/december2000.
Landram et al.; "Microchannel Flow Boiling Mechanisms Leading to Burnout"; Heat Transfer in Electronic Systems; HTD-vol. 292, pp. 129-136, ASME 1994.
Prasad; "Fin efficiency and mechanisms of heat exchange through fins in multi-stream plate-fin heat exchangers: development and application of a rating algorithm"; Int. J. Heat Mass Transfer; vol. 40, No. 18, pp. 4279-4288, 1997.
Van Reisen et al.; "The Placement of Two-Stream and Multi-Stream Heat-Exchangers in an Existing Network Through Path Analysis"; Computers chem. Engng, vol. 19, Suppl., pp. S143-S148, 1995.
Mollekopf et al.; "Multistream Heat Exchangers—Types, Capabilites and Limits of Design"; Heat and Mass Transfer in Refrigeration and Cryogenics, Hemisphere/Springer-Verlag, pp. 537-546.
Haseler; "Performance Calculation Methods for Multi-stream Plate-Fin Heat Exchangers," In: "Heat Exchangers: Theory and Practice," Hemisphere/McGraw Hill, pp. 495-505 (1983).
Jiang et al.; "Forced Convection Boiling in a Microchannel Heat Sink"; Journal of Microelectromechanical Systems; vol. 10, No. 1; Mar. 2001.
Kandlikar et al.; "High-Speed Photographic Observation of Flow Boiling of Water in Parallel Mini-Channels"; Proceedings of ASME NHTC'01 35th International Heat Transfer Conference; 2001, pp. 1-10.
Finn et al.; "Design, Equipment Changes Make Possible High $C_3$ Recovery"; *Oil & Gas Journal*; Jan. 3, 2000; pp. 37-44.
Finn et al.; "Developments in Natural Gas Liquefaction"; *Hydrocarbon Processing*; Apr. 1999; pp. 47-59.
*Hydrocarbon Processing*; May 2002; "LNG-Pro", p. 83.
*Hydrocarbon Processing*; May 2002; "NGL Recovery"; p. 83.
*Hydrocarbon Processing*; May 2002; LNG End Flash (Maxi LNG Production); p. 82.
*Hydrocarbon Processing*; May 2002; "LNG Plants"; p. 82.
*Hydrocarbon Processing*; May 2002; Cryomax DCP (Dual-Column Propane Recovery); p. 81.
*Hydrocarbon Processing*; May 2002; "Liquefin"; p. 81.
*Hydrocarbon Processing*; May 2002; Prico (LNG); p. 87.
*Hydrocarbon Processing*; May 2002; "Separex Membrane Systems"; p. 87.
U.S. Appl. No. 10/219,956, filed Aug. 15, 2002.
U.S. Appl. No. 10/222,196, filed Aug. 15, 2002.
U.S. Appl. No. 10/222,604, filed Aug. 15, 2002.
TeGrotenhuis et al.; "Optimizing Microchannel Reactors by Trading-Off Equilibrium and Reaction Kinetics through Temperature Management"; International Conference on Microreaction Technology; Mar. 10-14, 2002.
Srinivasan et al.; "Micromachined Reactors for Catalytic Partial Oxidation Reactions"; *AIChE Journal*; Nov. 1997; vol. 43, No. 11.
TeGrotenhuis et al.; "Optimizing Microchannel Reactors by Trading-Off Equilibrium and Reaction Kinetics through Temperature Management"; International Conference on Microreaction Technology; Mar. 10-14, 2002.
Smith, Eric M.; Thermal Design of Heat Exchangers. A Numerical Approach; 1997; Wiley; New York, pp. 279-288.
M. Matlosz et al.; Microreaction Technology; Proceedings of the Fifth International Conference on Microreaction Technology; Oct. 2001; Springer-Verlag.
Smith, Eric M.; Thermal Design of Heat Exchangers; A Numerical Approach; 1997; Wiley, New York.
Pettersen et al.; Development of Compact Heat Exchangers for $Co_2$ Air-Conditioning Systems; vol. 21, No. 3; pp. 180-193; 1998; Great Britain.
Wadekar, V. V.; Compact Heat Exchangers; A Che's Guide to Ches; American Insitute of Chemical Engineers; Dec. 2000; pp. 39-40; United States.
Rostami, A. A., et al.; Flow and Heat Transfer for Gas Flowing in Microchannels: A Review; Heat and Mass Transfer 38; 2002; pp. 359-367; Springer-Verlag.
Wegeng, R. S. et al.; Compact Fuel Processors for Fuel Cell Powdered Automobiles Based On Microchannel Technology; Fuel Cells Bulleting No. 28; pp. 8-13.
Kays, W. M.; Compact Heat Exchangers, Third Edition; 1984; Reprint Edition 1998 With Correctiosn; Kerlag Publishing Co.; Malabar, Florida.
Written Opinion, International Application No. PCT/US03/24903, dated Aug. 16, 2004.
Besser, Ronald S. "New Directions in Reactor Design Through Miniaturization". Sep. 13, 2002, Tulane Esngineering Forum.

* cited by examiner

PROCESS FOR COOLING A PRODUCT IN A HEAT EXCHANGER EMPLOYING MICROCHANNELS

This application is a continuation-in-part of U.S. application Ser. No. 10/219,990, filed Aug. 15, 2002, now U.S. Pat 6,622,519. This prior application is incorporated herein by reference.

CROSS-REFERENCE TO RELATED APPLICATIONS

The present application is related to the following commonly-assigned applications filed on Aug. 15, 2002: "Integrated Combustion Reactors and Methods of Conducting Simultaneous Endothermic and Exothermic Reaction," (U.S. application Ser. No. 10/222,196); "Multi-Stream Microchannel Device," (U.S. application Ser. No. 10/222,604); and "Process for Conducting an Equilibrium Limited Chemical Reaction in a Single Stage Process Channel," (U.S. application Ser. No. 10/219,956). These applications are incorporated herein by reference.

TECHNICAL FIELD

This invention relates to a process for cooling a product in a heat exchanger employing microchannels for the flow of refrigerant and product through the heat exchanger. The process is suitable for liquefying natural gas.

BACKGROUND OF THE INVENTION

Natural gas liquefication involves the conversion of natural gas to liquid form to facilitate transportation and storage of the gas. Current commercial cryogenic processes for making liquefied natural gas (LNG) include the steps of compressing a refrigerant and flowing it through a spiral wound or brazed aluminum heat exchanger. In the heat exchanger the refrigerant exchanges heat with the natural gas and liquefies the natural gas. These heat exchangers are designed to provide very close temperature approaches between the refrigerant and natural gas streams that are exchanging heat. Increasing the thermal efficiency of these heat exchangers through changes in design or materials of construction typically results in increasing the capital cost of the heat exchanger, increasing the pressure drop for the refrigerant flowing through the heat exchanger, or both. Increasing the pressure drop results in increased compressor requirements. The compressor service required for these processes comprises a significant portion of the capital and operating cost of these processes. The problem therefore is to provide a process that results in a reduction in the pressure drop for the refrigerant flowing through the heat exchanger. This would improve the productivity and economics of the process. The present invention provides a solution to this problem.

Due to the large capital cost of cryogenic liquefaction, LNG plants are being built with ever-larger capacities in order to meet project economic targets through economies of scale. This need for economies of scale has resulted in increases in the size of single-train LNG processes. Currently, the size of a single-train LNG process with one compressor is limited by the maximum size of the compressors that are available. The problem therefore is to reduce the compressor requirements for these processes in order to increase the maximum size for the LNG process that is possible. This invention provides a solution to this problem.

Aluminum is typically used as a material of construction in conventional cryogenic heat exchangers. Aluminum minimizes heat transfer resistance between fluid streams due to the fact that it is a high thermal conductive material. However, since it is a high thermal conductive material aluminum tends to decrease the effectiveness of the heat exchangers due to axial conduction. This limits the ability to shorten the length of these heat exchangers and thereby reduce the overall pressure drop. An advantage of the present invention is that it is not necessary to use high thermal conductive materials such as aluminum in constructing the heat exchanger used with the inventive process.

SUMMARY OF THE INVENTION

This invention relates to a process for cooling a fluid product in a heat exchanger, the process comprising: flowing a fluid refrigerant through a set of refrigerant microchannels in the heat exchanger; and flowing the product through a set of product microchannels in the heat exchanger, the product flowing through the product microchannels exchanging heat with the refrigerant flowing through the refrigerant microchannels, the product exiting the set of product microchannels being cooler than the product entering the set of product microchannels. The heat exchanger may be a two-stream heat exchanger, a three-stream heat exchanger, or a multi-stream heat exchanger. In one embodiment of the invention, the refrigerant flowing through the refrigerant microchannels comprises a refrigerant flowing through a set of first microchannels in the heat exchanger and another refrigerant flowing through a set of second microchannels in the heat exchanger, the refrigerant flowing through the set of second microchannels having a different composition and/or being at a different temperature and/or pressure than the refrigerant flowing through the set of first microchannels.

In one embodiment, the inventive process is operated using non-turbulent flow for the refrigerant flowing through the refrigerant microchannels. Also, in one embodiment, the microchannels may be relatively short, that is, up to about 10 meters in length. This provides for relatively low pressure drops as the refrigerant flows through the microchannels. These relatively low pressure drops reduce the power requirements for compressors used with such processes. For example, in one embodiment of the invention, a reduction in compression ratio of about 18% may be achieved for the inventive process used in making liquefied natural gas as compared to a comparable process not using microchannels for the flow of refrigerant in the heat exchanger.

Another advantage of the inventive process is that the use of microchannels in the heat exchanger decreases thermal and mass diffusion distances substantially as compared to prior art methods not using microchannels. This allows for substantially greater heat transfer per unit volume of heat exchanger than may be achieved with prior art heat exchangers.

BRIEF DESCRIPTION OF THE DRAWINGS

In the annexed drawings, like parts and features have like designations.

FIG. 5(*a*) is a cross-sectional view, and FIG. 5(*b*) is a lengthwise view.

FIG. 6(*a*) is a cross sectional view, and FIG. 6(*b*) is a lengthwise view.

DETAILED DESCRIPTION OF THE INVENTION

Figure 1:
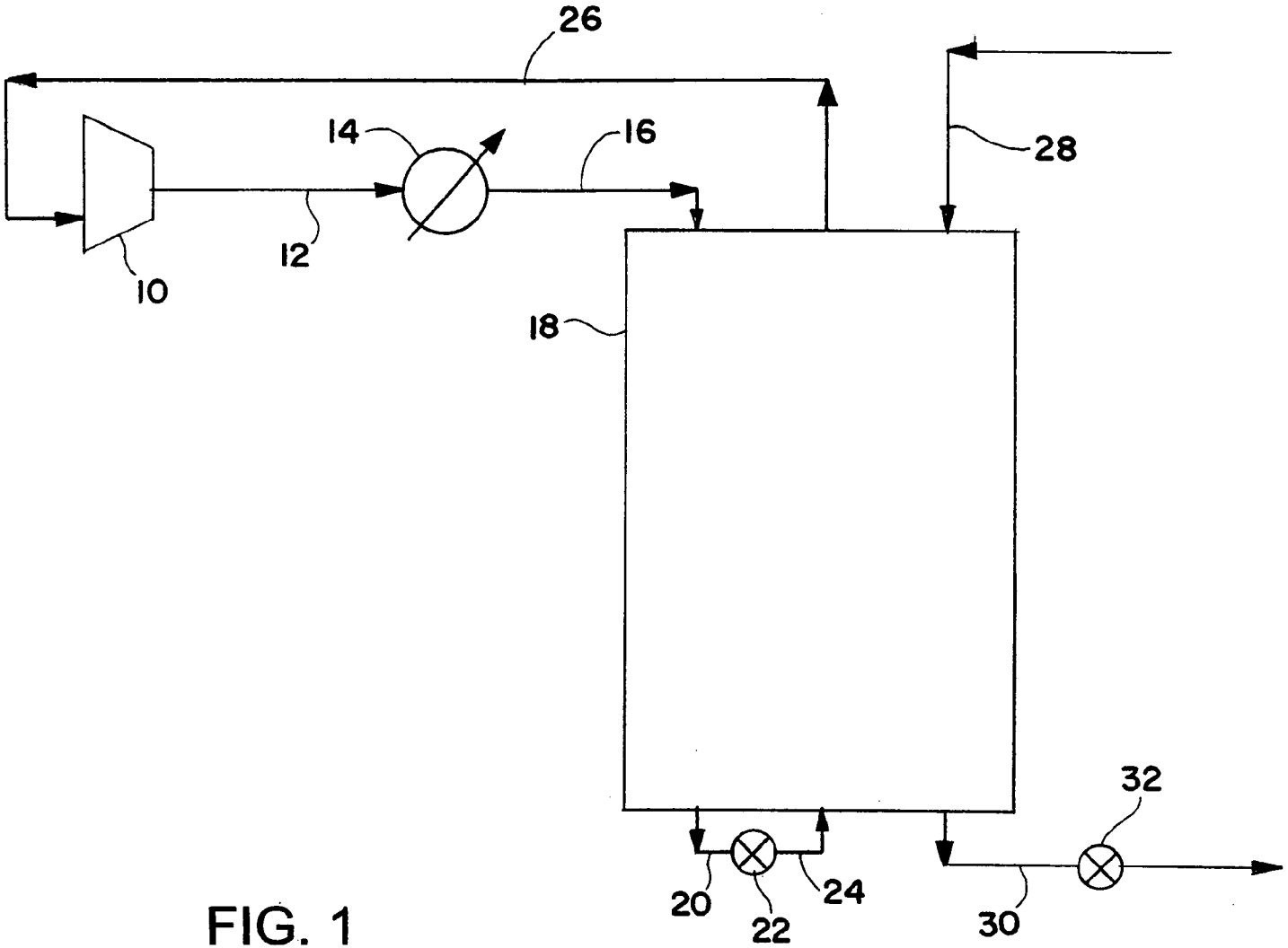
FIG. 1 is a flow sheet illustrating the inventive process in a particular form.

The term "microchannel" refers to a channel having at least one internal dimension of width or height of up to about 2 millimeters (mm), and in one embodiment from about 0.05 to about 2 mm, and in one embodiment from about 0.1 to about 1.5 mm, and in one embodiment about 0.2 to about 1 mm, and in one embodiment about 0.3 to about 0.7 mm, and in one embodiment about 0.4 to about 0.6 mm.

The term "non-turbulent" refers to the flow of a fluid through a channel that is laminar or in transition, and in one embodiment is laminar. The fluid may be a liquid, a gas, or a mixture thereof. The Reynolds Number for the flow of the fluid through the channel may be up to about 4000, and in one embodiment up to about 3000, and in one embodiment up to about 2500, and in one embodiment up to about 2300, and in one embodiment up to about 2000, and in one embodiment up to about 1800, and in one embodiment in the range of about 100 to 2300, and in one embodiment about 300 to about 1800. The Reynolds Number for single phase flow used herein is calculated using formula indicated below using the hydraulic diameter which is based on the actual shape of the microchannel being used.

$$Re_{single\ phase} = \frac{\rho V D_H}{\mu}$$

For two-phase flow, the Reynolds Number is defined separately for each phase (e.g., liquid and vapor phase) and is based on the actual shape of the microchannel being used.

$$Re_{two\ phase,\ liq} = \frac{\rho_{liq} V_{liq} D_H}{\mu_{liq}}$$

$$Re_{two\ phase,\ vap} = \frac{\rho_{vap} V_{vap} D_H}{\mu_{vap}}$$

The term "adjacent" when referring to the position of one channel relative to the position of another channel means directly adjacent such that a wall separates the two channels. This wall may vary in thickness. However, "adjacent" channels are not separated by an intervening channel that would interfere with heat transfer between the channels.

The term "fluid" refers to a gas, a liquid, or a gas or a liquid containing dispersed solids, or a mixture thereof. The fluid may be in the form of a gas containing dispersed liquid droplets.

The inventive process may be used to cool or liquefy any fluid product.

These include liquid products as well as gaseous products, including gaseous products requiring liquefication. The products that may be cooled or liquefied with this process include carbon dioxide, argon, nitrogen, helium, organic compounds containing 1 to about 5 carbon atoms including hydrocarbons containing 1 to about 5 carbon atoms (e.g., methane, ethane, ethylene, propane, isopropane, butene, butane, isobutane, isopentane, etc.), and the like. In one embodiment, the product is natural gas (NG) which is liquefied using the inventive process. The process may be used to preserve food, separate isomers, or remove impurities. The process may be used in the catalytic manufacture of ethyl chloride and anhydrous hydrogen chloride. The process may be used in the manufacture of dyes. The process may be used in dehydration processes, including the dehydration of natural gas. The process may be used in propane refrigeration loops for demethanizers and deethanizers. The process may be used in cryogenic distillation systems, including cryogenic systems for industrial gases.

The refrigerant may comprise a single-component or multi-component refrigerant or coolant material which in the state of a single phase or in the state of a liquid-vapor phase mixture functions as a refrigerant or coolant by absorbing heat from one or more products or other refrigerants or coolants while maintaining a relatively low temperature during the cooling or refrigeration process. In the case of a multi-component refrigerant mixture, the used components and compositions form an azeotrope or azeotropes at one composition or more than one composition. The azeotrope or azeotropes may be homogeneous or heterogeneous. The refrigerant mixtures also include the components and compositions that are non-azeotropic at one composition or more than one composition. The refrigerant may be any refrigerant suitable for use in a vapor compression refrigeration system. These include nitrogen, ammonia, carbon dioxide, organic compounds containing 1 to about 5 carbon atoms per molecule such as methylenechloride, the fluoro-chloromethanes (e.g., dichlordiflouromethane), hydrocarbons containing 1 to about 5 carbon atoms per molecule (e.g., methane, ethane, ethylene, propanes, butanes, pentanes, etc.), or a mixture of two or more thereof. The hydrocarbons may contain trace amounts of $C_6$ hydrocarbons. In one embodiment, the hydrocarbons are derived from the fractionation of natural gas.

The heat exchanger used with the inventive process employs the use of microchannels for the flow of both product and refrigerant. These microchannels may be referred to as product microchannels and refrigerant microchannels. The heat exchanger may be a two-stream (or two-fluid) heat exchanger (i.e., refrigerant stream and product stream), or a three-stream (or three-fluid) heat exchanger. The three-stream heat exchanger may employ a high pressure refrigerant (HPR) stream and a low pressure refrigerant (LPR) refrigerant stream, as well as a product stream. The three-stream heat exchanger may employ a product stream, and two refrigerant streams, each refrigerant stream employing a different refrigerant composition. The heat exchanger may be a multi-stream or multi-fluid heat exchanger employing more than three streams or fluids. For example, one or more additional streams employing refrigerants at different pressures, temperatures and/or compositions as compared to the other refrigerant streams may be employed. In one embodiment, the refrigerant may be in the form of a mixture of liquid and vapor with the liquid flowing through the heat exchanger as one stream in one set of microchannels and the vapor flowing through the heat exchanger as a separate stream in another set of microchannels.

The product flowing through the product microchannels in the heat exchanger may be in the form of a vapor, a liquid, or a mixture of vapor and liquid. In one embodiment, the product enters the product microchannels in the form of a vapor and exits the product microchannels in the form of a liquid. The Reynolds Number for the flow of gaseous product through the product microchannels may be from about 2000 to about 30,000, and in one embodiment about 15,000 to about 25,000. The Reynolds Number for the flow of liquid product through the product microchannels may be from about 1000 to about 10,000, and in one embodiment about 1500 to about 3000. Each of the product microchannels may have a cross section having any shape, for example, a rectangle, a square, circle, semi-circle, etc. The cross sectional shape and/or size of the microchannel may vary in the flow direction of the microchannels. Each of these microchannels may have an internal height (or gap size) of up to about 2 mm, and in one embodiment in the range of about 0.05 to about 2 mm, and in one embodiment about 0.3 to about 0.7 mm. The width of each of these microchannels may be of any dimension, for example, up to about 3 meters, and in one embodiment from about 0.01 to about 3 meters, and in one embodiment about 1 to about 3 meters. The length of each product microchannel may be of any dimension, for example, up to about 10 meters, and in one embodiment up to about 6 meters, and in one embodiment from about 0.5 to about 6 meters, and in one embodiment about 0.5 to about 2 meters, and in one embodiment about 1 meter. In one embodiment the length may range from about 0.5 to about 10 meters, and in one embodiment about 1 to about 6 meters, and in one embodiment about1 to about 3 meters. Different product microchannels may have different widths and/or different lengths. The pressure drop for the flow of product through the product microchannels may be up to about 30 pounds per square inch per foot of length of the microchannel (psi/ft), and in one embodiment from about 0.5 to about 30 psi/ft, and in one embodiment from about 1 to about 10 psi/ft.

The product entering the product microchannels may be at a pressure of up to about 5000 psig, and in one embodiment up to about 2500 psig, and in one embodiment up to about 1500 psig, and in one embodiment about 0 to about 800 psig, and in one embodiment about 200 to about 800 psig, and in one embodiment about 500 to about 800 psig; and a temperature of about −40 to about 40° C., and in one embodiment −10 to about 35° C. In one embodiment, the product is natural gas and the pressure is about 630 to about 640 psig and the temperature is about 30 to about35° C.

The product exiting the product microchannels may be at a pressure of up to about 5000 psig, and in one embodiment up to about 2500 psig, and in one embodiment up to about 1500 psig, and in one embodiment about 0 to about 800 psig, and in one embodiment about 0 to about 400 psig, and in one embodiment about 0 to about 150 psig, and in one embodiment about 0 to about 75 psig, and in one embodiment about 0 to about 20 psig, and in one embodiment about 2 to about 8 psig; and a temperature of about −170 to about −85° C., and in one embodiment −165 to about −110° C. In one embodiment, the product is liquefied natural gas, the pressure is about 0 to about 10 psig, and the temperature is about −160 to about −150° C.

The refrigerant flowing through the microchannels may be in the form of a vapor, a liquid, or a mixture of vapor and liquid. The Reynolds Number for the flow of vapor refrigerant flowing through the refrigerant microchannels may be up to about 100,000, and in one embodiment up to about 50,000, and in one embodiment up to about 10,000, and in one embodiment up to about 4000, and in one embodiment up to about 3000, and in one embodiment up to about 1500, and in one embodiment about 20 to about 1300. The Reynolds Number for the flow of liquid refrigerant through the refrigerant microchannels may be up to about 10,000, and in one embodiment up to about 6,000, and in one embodiment up to about 4000, and in one embodiment up to about 1500, and in one embodiment up to about 1000, and in one embodiment up to about 250, and in one embodiment about 30 to about 170. The flow of refrigerant through the refrigerant microchannels may be non-turbulent, that is, it may be laminar or in transition, and in one embodiment it may be laminar. Alternatively, the flow may be turbulent. The flow regime in the microchannels may change as the flow proceeds. The different flow regimes along the length of the microchannels may include laminar, partly laminar and partly transition, partly transition and partly turbulent, or combinations of laminar, transition and turbulent. This can be realized by adjusting such design parameters as channel gap size (which defines hydraulic diameter), local temperature, local pressure, and the like. Advantages of the inventive process (e.g., low pressure drop, compact process, etc.) may be achieved under these different flow regimes. Each of the refrigerant microchannels may have a cross section having any shape, for example, a square, rectangle, semi-circle, circle, etc. Each of the refrigerant microchannels may have an internal height (or gap size) of up to about 2 mm, and in one embodiment in the range of about 0.05 to about 2 mm, and in one embodiment about 0.2 to about 1 mm. The width of each of these microchannels may be of any dimension, for example, up to about 3 meters, and in one embodiment about 0.01 to about 3 meters, and in one embodiment about 0.1 to about 3 meters. The length of each of the refrigerant microchannels may be of any dimension, for example up to about 10 meters, and in one embodiment up to about 6 meters, and in one embodiment from about 0.5 to about 6 meters, and in one embodiment about 0.5 to about 2 meters, and in one embodiment about 1 meter. In one embodiment, the length may range from about 0.5 to about 10 meters, and in one embodiment from about 1 to about 6 meters, and in one embodiment from about 1 to about 3 meters.

The refrigerant entering the refrigerant microchannels may be at a pressure of up to about 2000 psig, and in one embodiment up to about 1500 psig, and in one embodiment up to about 1000 psig, and in one embodiment up to about 600 psig. In one embodiment, the pressure may be in the range of about 200 to about 2000 psig, and in one embodiment about 200 to about 1500 psig, and in one embodiment about 200 to about 1000 psig, and in one embodiment about 200 to about 600 psig, and in one embodiment about 200 to about 400 psig. In one embodiment the pressure may be up to about 100 psig, and in one embodiment about 0 to about 100 psig, and in one embodiment about 0 to about 60 psig, and in one embodiment about 20 to about 40 psig. The temperature of the refrigerant entering the refrigerant microchannels may be in the range of about −180 to about 100° C., and in one embodiment about −170 to about 50° C. In one embodiment the temperature may be in the range of about −50 to about 100° C., and in one embodiment about 0 to about 50° C. In one embodiment the temperature may be in the range of about −180 to about −90° C., and in one embodiment about −170 to about −125° C.

The refrigerant exiting refrigerant microchannels may be at a pressure of up to about 2000 psig, and in one embodiment up to about 1000 psig, and in one embodiment up to about 500 psig. In one embodiment, the pressure may be in the range of about 200 to about 400 psig, and in one embodiment about 300 to 350 psig. In one embodiment, the pressure may be in the range of about 0 to about 100 psig, and in one embodiment about 0 to about 40 psig. The temperature of the refrigerant exiting the refrigerant microchannel may be in the range of about −180 to about 100° C., and in one embodiment about −180 to about 50° C., and in one embodiment about −160 to about 30° C. In one embodiment, the temperature may be in the range of about −180 to about −90° C., and in one embodiment about −180 to about −120° C. In one embodiment, the temperature may be in the range of about −50 to about 100° C., and in one embodiment about 0 to about 50° C., and in one embodiment about 10 to about 30° C. In one embodiment, the pressure may be about 28 psig and the temperature may be about 21° C. The pressure drop for the flow of refrigerant through the refrigerant microchannels may be up to about 30 psi/ft, and in one embodiment up to about 15 psi/ft, and in one embodiment up to about 10 psi/ft, and in one embodiment from about 0.1 to about 7 psi/ft, and in one embodiment about 0.1 to about 5 psi/ft, and in one embodiment from about 0.1 to about 3.5 psi/ft.

The inventive process, as illustrated in FIG. 1, will now be described. This process employs heat exchanger 18 which is a three-stream heat exchanger. A gaseous refrigerant is compressed in compressor 10. The compressed refrigerant flows from compressor 10 through line 12 to condenser 14. In condenser 14 the refrigerant is partially condensed. At this point the refrigerant typically is in the form of a mixture of vapor and liquid. The refrigerant flows from condenser 14 through line 16 to a set of first microchannels in heat exchanger 18. The refrigerant flows through a set of first microchannels in heat exchanger 18 and exits the heat exchanger through line 20. The refrigerant flowing through the set of first microchannels may be at a pressure of up to about 2000 pounds per square inch gage (psig), and in one embodiment up to about 1500 psig, and in one embodiment up to about 1000 psig, and in one embodiment in the range of about 200 to about 1000 psig. This refrigerant may be characterized as a high pressure refrigerant. Upon exiting the set of first microchannels the refrigerant is typically in the form of a liquid. The refrigerant then flows through expansion device 22 where the pressure and/or temperature of the refrigerant are reduced. At this point the refrigerant is typically in form of a mixture of vapor and liquid. From expansion device 22 the refrigerant flows through line 24 to a set of second microchannels in heat exchanger 18. The refrigerant flows through the set of second microchannels in heat exchanger 18 where it is warmed and then exits heat exchanger 18 through line 26. The refrigerant flowing through the set of second microchannels may be at a pressure in the range of up to about 1000 psig and may be characterized as a low pressure refrigerant. Upon exiting the second set of microchannels the refrigerant is typically in the form of a vapor. The refrigerant is then returned to compressor 10 through line 26 where the refrigeration cycle starts again.

The ratio of the pressure of the high pressure refrigerant to the pressure of the low pressure refrigerant may be in the range of about 2:1 to about 500:1, and in one embodiment about 2:1 to about 100:1, and in one embodiment about 2:1 to about 50:1, and in one embodiment about 10:1. The difference in pressure between the high pressure refrigerant and the low pressure refrigerant may be at least about 10 psi, and in one embodiment at least about 50 psi, and in one embodiment at least about 100 psi, and in one embodiment at least about 150 psi; and in one embodiment at least about 200 psi, and in one embodiment at least about 250 psi.

The product to be cooled or liquified enters heat exchanger 18 through line 28 and flows through a set of third microchannels in heat exchanger 18. In heat exchanger 18, the set of first microchannels exchange heat with the set of second microchannels, and the set of second microchannels exchange heat with the set of third microchannels. The product is cooled or liquefied and exits heat exchanger 18 through line 30 and valve 32.

The compressor 10 may be of any size and design. However, an advantage of the inventive process is that due to reduced pressure drops that are achieved with the inventive process for the refrigerant flowing through the microchannels, the power requirements for the compressor are reduced. The refrigerant may be compressed in compressor 10 to a pressure of up to about 2000 psig, and in one embodiment up to about 1500 psig, and in one embodiment up to about 1000 psig, and in one embodiment up to about 600 psig. In one embodiment, the pressure may be in the range of about 200 to about 2000 psig, and in one embodiment about 200 to about 1500 psig, and in one embodiment about 200 to about 1000 psig, and in one embodiment about 200 to about 600 psig, and in one embodiment about 200 to about 400 psig. The temperature of the compressed refrigerant may be in the range of about −50 to about 500° C., and in one embodiment about 0 to about 500° C., and in one embodiment about 50 to about 500° C., and in one embodiment about 100 to about 200° C. In one embodiment, the refrigerant is compressed to a pressure of about 325 to about 335 psig and the temperature is about 150 to about 160° C.

The refrigerant may be cooled, partially condensed or fully condensed in condenser 14. The condenser may be any conventional size and design. The partially condensed refrigerant may be at a pressure of up to about 2000 psig, and in one embodiment up to about 1000 psig, and in one embodiment about 200 to about 1000 psig, and in one embodiment about 200 to about 600 psig, and in one embodiment about 200 to about 400 psig; and a temperature of about −50 to 100° C., and in one embodiment about 0 to about 100° C., and in one embodiment about 0 to about 50° C. In one embodiment, the pressure is about 320 to about 330 psig, and the temperature is about 25 to about 35° C.

Figure 2:
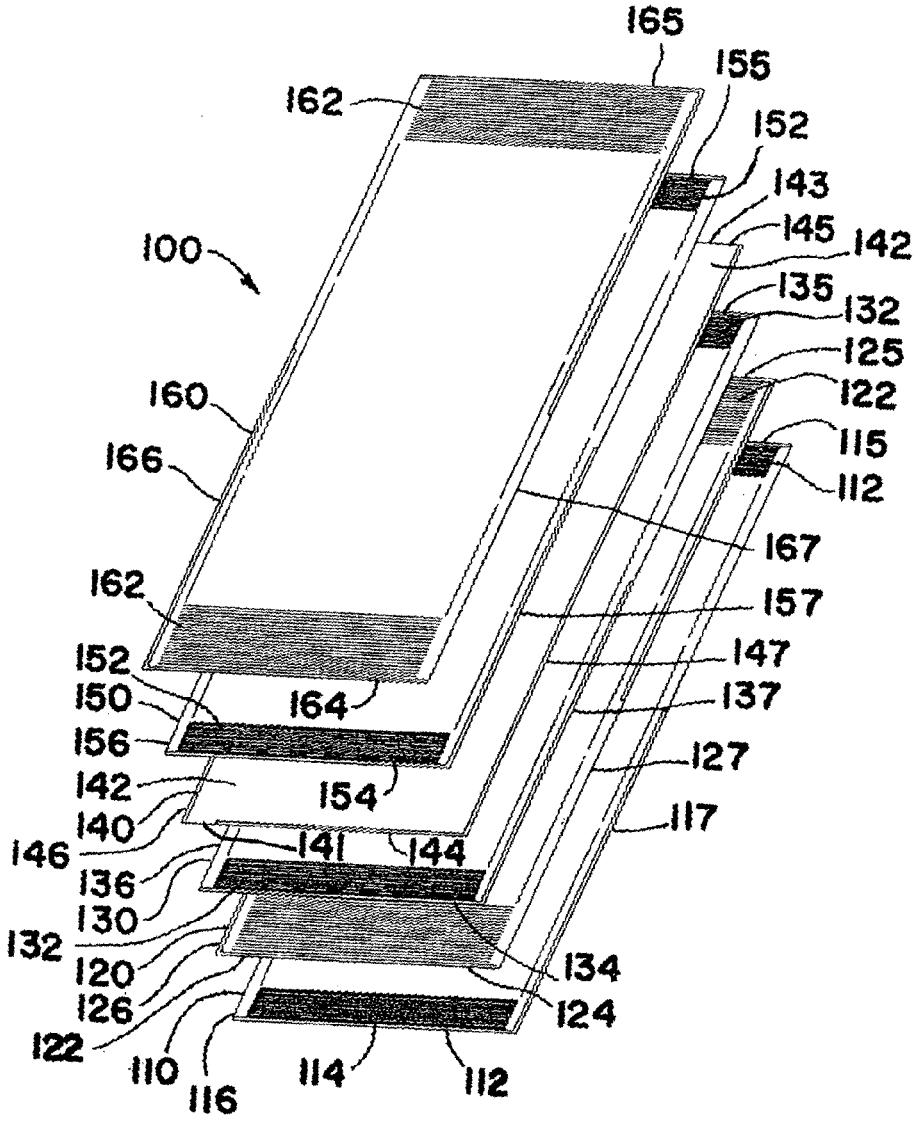
FIG. 2 is a schematic illustration showing an exploded view of one embodiment of a repeating unit of microchannel layers that may be used in a heat exchanger employed with the inventive process.

The heat exchanger 18 contains layers of microchannels corresponding to the sets of first, second and third microchannels. The layers may be aligned one above another in any desired sequence. This is illustrated in FIG. 2 which shows one embodiment of a sequence of layers that may be used. Referring to FIG. 2, layers of microchannels are stacked one above another to provide a repeating unit 100 of microchannel layers which is comprised of microchannel layers 110, 120, 130, 140,150 and 160. Microchannels layers 120 and 160 correspond to the set of first microchannels which is provided for the flow of the high pressure refrigerant. Microchannel layers 110, 130 and 150 correspond to the set of second microchannels which is provided for the flow of the low pressure refrigerant. Microchannel layer 140 corresponds to the set of third microchannels which is provided for the flow of the product to be cooled or liquefied. Microchannel layer 110 contains a plurality of second microchannels 112 arranged in parallel and extending along the length of microchannel layer 110 from end 114 to end 115, each microchannel 112 extending along the width of microchannel layer 110 from one end 116 to the other end 117 of microchannel layer 110. Microchannel layer 120 contains a plurality of first microchannels 122 arranged in parallel and extending along the length of microchannel layer 120 from end 124 to end 125, each microchannel 122 extending along the width of microchannel layer 120 from one end 126 to the other end 127 of microchannel layer 120. Microchannel layer 130 contains a plurality of second microchannels 132 arranged in parallel and extending along the length of microchannel layer 130 from end 134 to end 135, each microchannel 132 extending along the width of microchannel layer 130 from one end 136 to the other end 137 of microchannel layer 130. Microchannel layer 140 contains a single third microchannel 142 which extends along the length of microchannel layer 140 from end 144 to end 145, and along the width of microchannel layer 140 from one end 146 to the other end 147 of microchannel layer 140. Microchannel layer 150 contains a plurality of second microchannels 152 arranged in parallel and extending along the length of microchannel layer 150 from end 154 to end 155, each microchannel 152 extending along the width of microchannel layer 150 from one end 156 to the other end 157 of microchannel layer 150. Microchannel layer 160 contains a plurality of first microchannels 162 arranged in parallel and extending along the length of microchannel layer 160 from end 164 to end 165, each microchannel 162 extending along the width of microchannel layer 160 from one end 166 to the other end 167 of microchannel layer 160. Header and footer manifolds along with associated valves and the like may be used with the microchannels to provide for flow of product or refrigerant to and from the microchannels.

Figure 3:
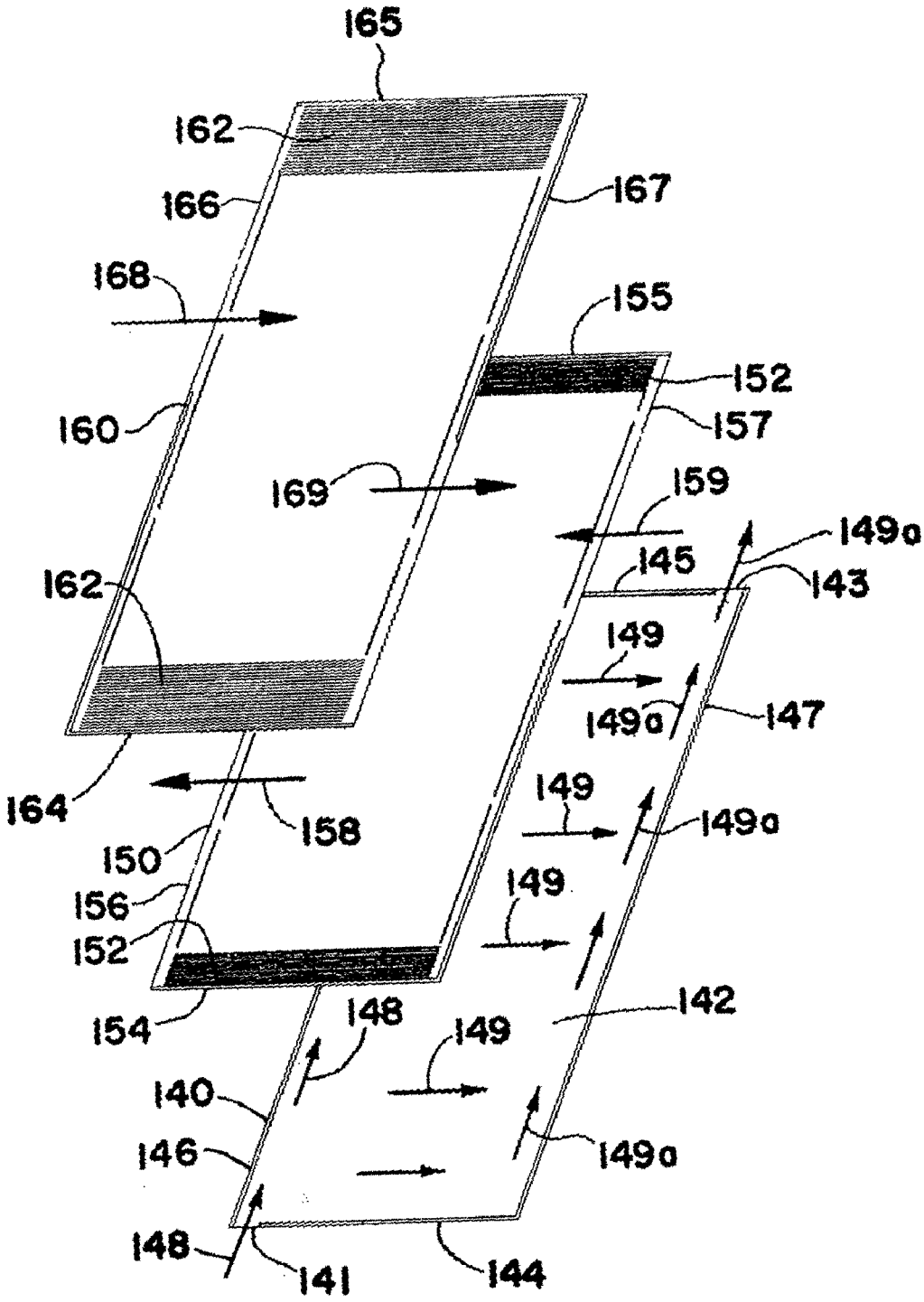
FIG. 3 is a schematic illustration showing an exploded view of microchannel layers used in one embodiment of a heat exchanger that may be employed with the inventive process with the direction of flow of refrigerant and gaseous product to be liquefied being indicated.

The flow of the refrigerant and product through the microchannels in heat exchanger 18 may be illustrated, in part, in FIG. 3. Referring to FIG. 3, high pressure refrigerant flows through microchannels 162 in microchannel layer 160 in the direction indicated by arrows 168 and 169. Low pressure refrigerant flows through microchannels 152 in microchannel layer 150 in the direction indicated by arrows 158 and 159. The flow of the high pressure refrigerant may be countercurrent to the flow of the low pressure refrigerant. Alternatively, the flow of high pressure refrigerant may be cocurrent, or cross-current relative to the flow of low pressure refrigerant. A combination of countercurrent, cocurrent and/or cross-current flow may be used. The product to be cooled or liquefied enters microchannel 142 through entrance 141 as indicated by arrows 148, flows through microchannel 142 as indicated by arrows 149, and exits microchannel 142 through exit 143 as indicated by arrows 149*a*. The product to be cooled or liquefied flows through microchannel 142 in a direction that is substantially counter current relative to the flow of the low pressure refrigerant through the microchannels 152 as indicated by arrows 149. Alternatively, the flow of product may be cocurrent or cross-current relative to the flow of low pressure refrigerant. The flow of high pressure refrigerant through microchannels 122 is in the same direction as the flow of high pressure refrigerant through microchannels 162. The flow of low pressure refrigerant through microchannels 112 and 132 is in the same direction as the flow of low pressure refrigerant through microchannels 152.

The number of microchannels in each of the microchannel layers 110, 120, 130, 140, 150 and 160 may be any desired number, for example, one, two, three, four, five, six, eight, tens, hundreds, thousands, tens of thousands, hundreds of thousands, millions, etc. Similarly, the number of repeating units 100 of microchannel layers may be any desired number, for example, one, two, four, six, eight, tens, hundreds, thousands, tens of thousands, hundreds of thousands, millions, etc.

Referring to FIGS. 1 and 2, in heat exchanger 18 the high pressure refrigerant flows through a set of first microchannels corresponding to microchannels 122 and 162 and exits the heat exchanger through line 20. The flow of high pressure refrigerant through the set of first microchannels 122 and 162 may be non-turbulent, that is, it may be laminar or in transition, and in one embodiment it may be laminar. Alternatively, the flow may be turbulent. The refrigerant entering the set of first microchannels 122 and 162 may be in the form of a vapor, a liquid, or a mixture of vapor and liquid, while the refrigerant exiting these microchannels may be in the form of a liquid. The Reynolds Number for the flow of vapor refrigerant flowing through these microchannels may be up to about 100,000, and in one embodiment up to about 50,000, and in one embodiment up to about 10,000, and in one embodiment up to about 4000, and in one embodiment up to about 3000, and in one embodiment up to about 1500, and in one embodiment about 20 to about 1300. The Reynolds Number for the flow of liquid refrigerant through these microchannels may be up to about 10,000, and in one embodiment up to about 6,000, and in one embodiment up to about 4000, and in one embodiment up to about 1500, and in one embodiment up to about 1000, and in one embodiment up to about 250, and in one embodiment about 30 to about 170. The flow regime in the microchannels may change as the flow proceeds. The different flow regimes along the length of the microchannels may include laminar, partly laminar and partly transition, partly transition and partly turbulent, or combinations of laminar, transition and turbulent. This may be realized by adjusting such design parameters, as channel gap size (which defines hydraulic diameter), local temperature, local pressure, and the like. Advantages of the inventive process (e.g., low pressure drop, compact process, etc.) may be achieved under these different flow regimes. Each of the microchannels 122 and 162 in the set of first microchannels may have a cross section having any shape, for example, a square, rectangle, semi-circle, circle, etc. Each of these microchannels 122 and 162 may have an internal height or gap of up to about 2 mm, and in one embodiment in the range of about 0.05 to about 2 mm, and in one embodiment about 0.2 to about 1 mm. The width of each of these microchannels may be of any dimension, for example, up to about 3 meters, and in one embodiment about 0.01 to about 3 meters, and in one embodiment about 0.1 to about 3 meters. The length of each of these microchannels may be up to about 10 meters, and in one embodiment up to about 6 meters, and in one embodiment from about 0.5 to about 6 meters, and in one embodiment about 0.5 to about 2 meters, and in one embodiment about 1 meter. In one embodiment, the length may range from about 0.5 to about 10 meters, and in one embodiment from about 1 to about 6 meters, and in one embodiment from about 1 to about 3 meters. The refrigerant exiting the set of first microchannels may be at a pressure of up to about 2000 psig, and in one embodiment up to about 1000 psig, and in one embodiment about 200 to about 1000 psig, and in one embodiment about 300 to about 650 psig; and a temperature of about −180 to about −90° C., and in one embodiment about −180 to about −120° C., and in one embodiment about −160 to about −140° C. In one embodiment, the pressure is about 320 to about 330 psig and the temperature is about −160 to about −1 50° C. The pressure drop for the flow of high pressure refrigerant through the set of first microchannels may be up to about 30 psi/ft, and in one embodiment up to about 15 psi/ft, and in one embodiment up to about 10 psi/ft, and in one embodiment from about 0.1 to about 7 psi/ft, and in one embodiment about 0.1 to about 5 psi, and in one embodiment from about 0.1 to about 3.5 psi/ft.

The high pressure refrigerant exits the set of first microchannels through line 20 and flows through expansion device 22. Expansion device 22 may be of any conventional design. The expansion device may be one or a series of expansion valves, one or a series of flash vessels, or a combination of the foregoing. The refrigerant exiting the expansion device 22 may be at a pressure of up to about 1000 psig, and in one embodiment up to about 500 psig, and in one embodiment from about 0 to about 100 psig, and in one embodiment about 0 to about 60 psig, and in one embodiment about 20 to about 40 psig; and a temperature of about −180 to about −90° C., and in one embodiment about −180 to about −120° C., and in one embodiment about −170 to about −125° C., and in one embodiment −170 to about −150° C. In one embodiment, the pressure is about 25 to about 35 psig, and the temperature is about −160 to about −150° C. At this point the refrigerant may be referred to as a low pressure refrigerant.

The low pressure refrigerant flows from expansion device 22 through line 24 back into heat exchanger 18. In heat exchanger 18 the low pressure refrigerant flows through a set of second microchannels corresponding to microchannels 112, 132 and 152 in FIG. 2 and exits the heat exchanger through line 26. The flow of refrigerant through the set of second microchannels 112, 132 and 152 may be non-turbulent, that is, it may be laminar or in transition, and in one embodiment it may be laminar. The refrigerant entering the second set of microchannels is typically in the form of a mixture of vapor and liquid, while the refrigerant exiting these microchannels is typically in the form of a vapor. The Reynolds Number for the flow of vapor refrigerant through these microchannels may be up to about 4000, and in one embodiment up to about 2000, and in one embodiment in the range of about 100 to about 2300, and in one embodiment about 200 to about 1800. The Reynolds Number for the flow of liquid refrigerant through these microchannels may be up to about 4000, and in one embodiment up to about 3000, and in one embodiment up to about 2000, and in one embodiment up to about 1000, and in one embodiment up to about 500, and in one embodiment up to about 250, and in one embodiment about 5 to about 100, and in one embodiment about 8 to about 36. Each of the microchannels 112, 132 and 152 in the second set of microchannels may have a cross section having any shape, for example, a square, rectangle, circle, semi-circle, etc. Each microchannel may have an internal height or gap of up to about 2 mm, and in one embodiment in the range of about 0.05 to about 2 mm, and in one embodiment about 0.2 to about 1 mm. The width of each of these microchannels may be of any dimension, for example, up to about 3 meters, and in one embodiment about 0.01 to about 3 meters, and in one embodiment about 0.1 to about 3 meters. The length of each microchannel may be of any dimension, for example, up to about 10 meters, and in one embodiment up to about 6 meters, and in one embodiment from about 0.5 to about 6 meters, and in one embodiment about 0.5 to about 3 meters, and in one embodiment about 0.5 to about 2 meters, and in one embodiment about 1 meter. In one embodiment, the length may range from 0.5 to about 10 meters, and in one embodiment about 1 to about 6 meters, and in one embodiment about 1 to about 3 meters. The refrigerant exiting the set of second microchannels may be at a pressure of up to about 1000 psig, and in one embodiment up to about 500 psig, and in one embodiment up to about 100 psig, and in one embodiment about 0 to about 100 psig, and in one embodiment about 0 to about 60 psig, and in one embodiment about 20 to about 40 psig; and a temperature of about −50 to about 100° C., and in one embodiment about 0 to about 100° C., and in one embodiment 0 to about 50° C., and in one embodiment about 0 to about 40° C., and in one embodiment about 10 to about 30° C. In one embodiment, the pressure is about 25 to about 30 psig and the temperature is about 15 to about 25° C. The pressure drop for the flow of low pressure refrigerant through the set of second microchannels in heat exchanger 18 may be up to about 30 psi/ft, and in one embodiment up to about 15 psi/ft, and in one embodiment up to about 10 psi/ft. In one embodiment, the pressure drop may be from about 0.1 to about 15 psi/ft, and in one embodiment from about 0.1 to about 10 psi/ft, and in one embodiment about 0.1 to about 7 psi/ft, and in one embodiment about 0.1 to about 3.5 psi/ft.

The product to be cooled or liquefied flows through line 28 to heat exchanger 18 and then through the set of third microchannels corresponding to microchannel 142 in FIG. 2. In one embodiment, the product is pre-cooled prior to entering heat exchanger 18. The flow of product through the set of third microchannels may be laminar, in transition or turbulent. The flow regime in the microchannels may change as the flow proceeds. The different flow regimes along the length of the microchannel may include laminar, partly laminar and partly transition, partly transition and partly turbulent, or combinations of laminar, transition and turbulent. This may be realized by adjusting such design parameters as channel gap size (which defines hydraulic diameter), local temperature, local pressure, and the like. Advantages of the inventive process (e.g., low pressure drop, compact process, etc.) may be achieved under these different flow regimes. In one embodiment, the product entering the third set of microchannels comprises a gas, and the product exiting these microchannels comprises a liquid. The Reynolds Number for the flow of gaseous product through the set of third microchannels may be from about 2000 to about 30,000, and in one embodiment about 15,000 to about 25,000. The Reynolds Number for the flow of liquid product through the set of third microchannels may be from about 1000 to about 10,000, and in one embodiment about 1500 to about 3000. Each of the microchannels in the third set of microchannels may have a cross section having any shape, for example, a square, rectangle, circle, semi-circle, etc. Each of these microchannels may have an internal height or gap of up to about 2 mm, and in one embodiment in the range of about 0.05 to about 2 mm, and in one embodiment about 0.3 to about 0.7 mm. The width of each of these microchannels as measured from side 144 to side 145 in FIG. 2 may be of any dimension, for example, from about 0.01 to about 3 meters, and in one embodiment about 1 to about 3 meters. The cross sectional shape and/or size of the microchannel may vary in the flow direction of the microchannels. The length of each microchannel in the set of third microchannels as measured from side 146 to side 147 in FIG. 2 may be of any dimension, for example, up to about 10 meters, and in one embodiment up to about 6 meters, and in one embodiment from about 0.5 to about 6 meters, and in one embodiment about 0.5 to about 2 meters, and in one embodiment about 1 meter. In one embodiment the length may range from about 0.5 to about 10 meters, and in one embodiment about 1 to about 6 meters, and in one embodiment about 1 to about 3 meters. Different microchannels may have different widths and/or different lengths. The pressure drop for the flow of product through the set of third microchannels in heat exchanger 18 may be up to about 30 psi/ft, and in one embodiment from about 0.5 to about 30 psi/ft, and in one embodiment from about 1 to about 10 psi/ft.

The product entering the set of third microchanne Is may be at a pressure of up to about 5000 psig, and in one embodiment up to about 2500 psig, and in one embodiment up to about 1500 psig, and in one embodiment about 0 to about 800 psig, and in one embodiment about 200 to about 800 psig, and in one embodiment about 500 to about 800 psig; and a temperature of about −40 to about 40° C., and in one embodiment −10 to about 35° C. In one embodiment, the product is natural gas and the pressure is about 630 to about 640 psig and the temperature is about 30 to about 35° C.

The product exiting the set of third microchannels in line 30 or downstream of valve 32 may be at a pressure of up to about 5000 psig, and in one embodiment up to about 2500 psig, and in one embodiment up to about 1500 psig, and in one embodiment about 0 to about 800 psig, and in one embodiment about 0 to about 400 psig, and in one embodiment about 0 to about 150 psig, and in one embodiment about 0 to about 75 psig, and in one embodiment about 0 to about 20 psig, and in one embodiment about 2 to about 8 psig; and a temperature of −170 to about −85° C., and in one embodiment −165 to about −110° C. In one embodiment, the product is liquefied natural gas, the pressure is about 0 to about 10 psig, and the temperature is about −160 to about −150° C.

Figure 9:
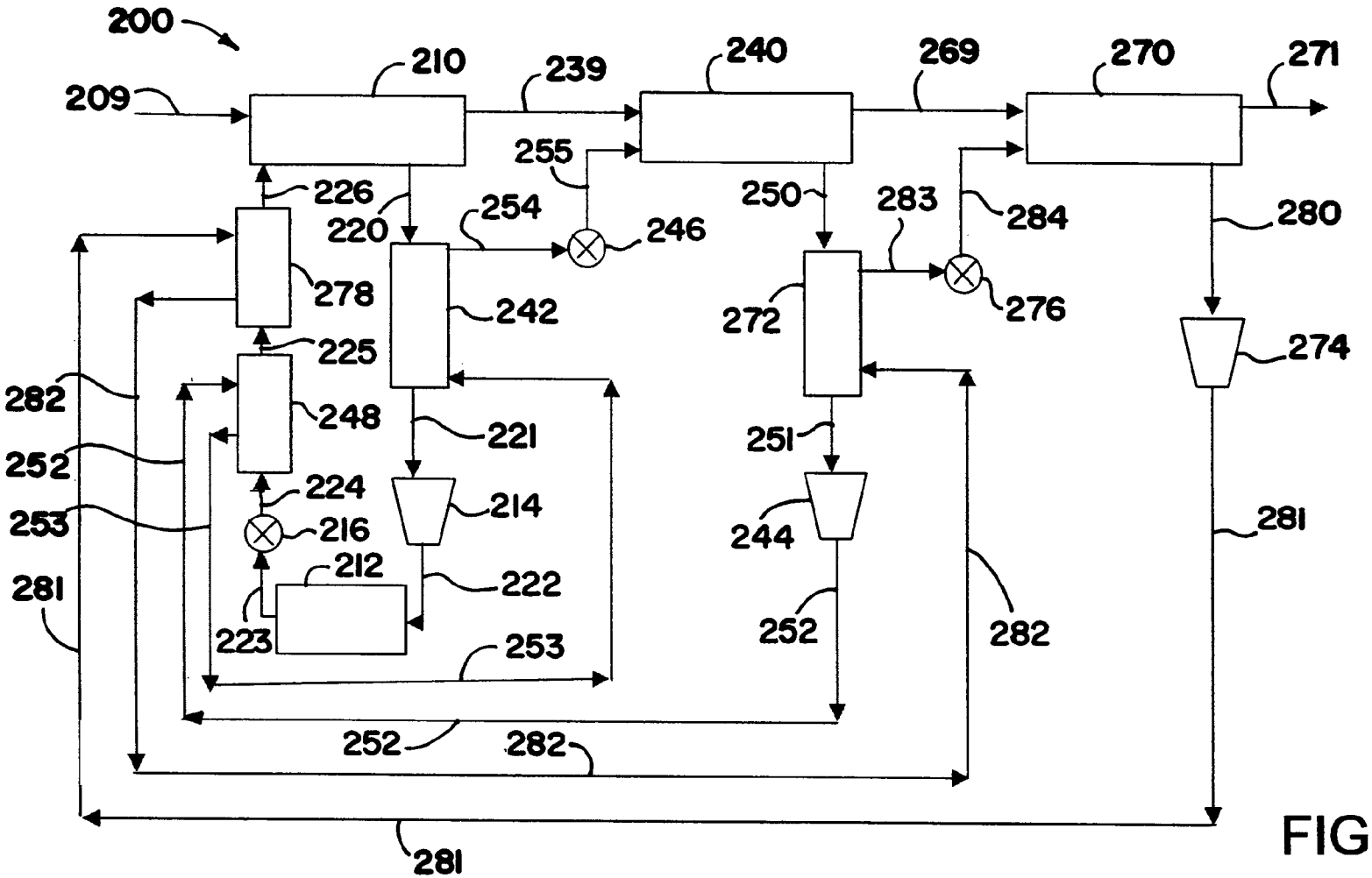
FIG. 9 is a flow sheet illustrating an alternate embodiment of the inventive process.

The inventive process, as illustrated in FIG. 9, will now be described. This process employs the use of three microchannel heat exchangers (i.e., microchannel heat exchangers 210, 240 and 270) each of which is a two stream heat exchanger, one stream being the product stream and the other being a refrigerant stream. The process illustrated in FIG. 9 relates to a cascade cycle of heat exchangers which is used to cool or liquefy a product. The product to be cooled or liquefied (e.g., natural gas) enters first heat exchanger 210 from line 209, flows through a plurality of product microchannels in heat exchanger 210 where it is cooled, and then exits heat exchanger 210 through line 239. The product then enters another or second heat exchanger 240 where it flows through a plurality of product microchannels and is further cooled, and then exits heat exchanger 240 through line 269. The product then flows into third heat exchanger 270 where it flows through a plurality of product microchannels and undergoes further cooling, and exits third heat exchanger 270 through line 271. In one embodiment, natural gas enters the process through line 209 and exits the process through line 271 as liquefied natural gas. The product entering first heat exchanger 210 may be at a pressure of up to about 5000 psig, and in one embodiment up to about 2500 psig, and in one embodiment up to about 1500 psig, and in one embodiment about 0 to about 800 psig, and in one embodiment about 200 to about 800 psig; and a temperature in the range of about −40 to about 40° C., and in one embodiment about −10 to about 35° C. In one embodiment, the product is natural gas and the pressure is about 630 to about 640 psig and the temperature is about 30 to about 35° C. The product entering the second heat exchanger 240 may be at a pressure of about 0 to about 5000 psig, and in one embodiment about 200 to about 800 psig; and a temperature of about −90 to about 0° C., and in one embodiment about −50 to about −20° C. In one embodiment the product is natural gas and the pressure is about 630 to about 640 psig and the temperature is about −30° C. The product entering the third heat exchanger 270 may be at a pressure of about 0 to about 5000 psig, and in one embodiment about 200 to about 800 psig; and a temperature in the range of about −180 to about −30° C., and in one embodiment about −85 to about −50° C. In one embodiment, the product is natural gas and the pressure is about 630 to about 640 psig and the temperature is about −70° C. The product exiting the third heat exchanger 270 may be at a pressure of up to about 5000 psig, and in one embodiment about 0 to about 800 psig; and a temperature of about −170 to about −85° C., and in one embodiment about −165 to about −110° C. In one embodiment, the product exiting the third heat exchanger 270 is liquefied natural gas having a pressure of about 0 to about 10 psig, and a temperature of about −160 to about −150° C.

The product is cooled in first heat exchanger 210 using a first refrigerant which flows through a plurality of refrigerant microchannels in heat exchanger 210. The refrigerant microchannels in heat exchanger 210 are interleaved with the product microchannels in heat exchanger 210 to effect exchange of heat between the product microchannels and the refrigerant microchannels. This is discussed in greater detail below. The first refrigerant then flows from first heat exchanger 210 through line 220 to condenser 242, through condenser 242 to line 221, through line 221 to compressor 214, through compressor 214 to line 222, through line 222 to condenser 212, through condenser 212 to line 223, through line 223 to expansion device 216, through expansion device 216 to line 224, through line 224 to cooler 248, through cooler 248 to line 225, through line 225 to cooler 278, through cooler 278 to line 226, and through line 226 back into first heat exchanger 210. The first refrigerant may be any of the refrigerants discussed above. In one embodiment, the first refrigerant is propane or propylene. The first refrigerant flowing through line 220 to condenser 242 may be at a pressure of about −10 to about 100 psig (i.e., about 5 to about 115 pounds per square inch absolute (psia)), and in one embodiment about 0 to about 20 psig; and a temperature of about −50 to about 20° C., and in one embodiment about −40 to about −20° C. In one embodiment, the first refrigerant is propane which is at a pressure of about 8 psig and a temperature of about −32° C. The first refrigerant flowing through line 221 to compressor 214 may be at a pressure of about −10 to about 50 psig, and in one embodiment about 0 to about 20 psig; and a temperature of about −40 to about 50° C., and in one embodiment about −10 to about 30° C. In one embodiment, the first refrigerant is propane which is at a pressure of about 8 psig and a temperature of about 25° C. The first refrigerant flowing through line 222 to condenser 212 may be at a pressure of about 20 to about 300 psig, and in one embodiment about 100 to about 200 psig; and a temperature of about 50 to about 250° C., and in one embodiment about 100 to about 200° C. In one embodiment, the first refrigerant is propane which is at a pressure of about 130 psig and a temperature of about 141° C. The first refrigerant flowing through line 223 to expansion device 216 may be at a pressure of about 20 to about 300 psig, and in one embodiment about 100 to about 200 psig; and a temperature of about −10 to about 100° C., and in one embodiment about 10 to about 35° C. In one embodiment, the first refrigerant is propane which is at a pressure of about 130 psig and a temperature of about 27° C. The first refrigerant flowing through line 224 to cooler 248 may be at a pressure of about −10 to about 100 psig, and in one embodiment about 0 to about 20 psig; and a temperature of about −50 to about 20° C., and in one embodiment about −40 to about −20° C. In one embodiment, the first refrigerant is propane which is at a pressure of about 8 psig and a temperature of about −32° C. The first refrigerant flowing through line 225 to cooler 278 may be at a pressure of about −10 to about 100 psig, and in one embodiment about 0 to about 20 psig; and a temperature of about −50 to about 20° C., and in one embodiment about −40 to about −20° C. In one embodiment, the first refrigerant is propane which is at a pressure of about 8 psig and a temperature of about −32° C. The first refrigerant flowing through line 226 to first heat exchanger 210 may be at a pressure of about −10 to about 50 psig, and in one embodiment about 0 to about 20 psig; and a temperature of about −50 to about 20° C., and in one embodiment about −40 to about −20° C. In one embodiment, the first refrigerant is propane which is at a pressure of about 8 psig and a temperature of about −32° C.

The product is cooled in another or second heat exchanger 240 using a second refrigerant which flows through a plurality of refrigerant microchannels in heat exchanger 240. The refrigerant microchannels in heat exchanger 240 are interleaved with the product microchannels in heat exchanger 240 to effect exchange of heat between the product microchannels and the refrigerant microchannels. This is discussed in greater detail below. The first refrigerant then flows from second heat exchanger 240 through line 250 to condenser 272, through condenser 272 to line 251, through line 251 to compressor 244, through compressor 244 to line 252, through line 252 to cooler 248, through cooler 248 to line 253, through line 253 to condenser 242, through condenser 242 to line 254, through line 254 to expansion device 246, through expansion device 246 to line 255, and through line 255 back into second heat exchanger 240. The second refrigerant may be any of the refrigerants discussed above. In one embodiment, the second refrigerant is ethane or ethylene. The second refrigerant flowing through line 250 to condenser 272 may be at a pressure of about −10 to about 250 psig, and in one embodiment about 0 to about 50 psig; and a temperature of about −120 to about 0° C., and in one embodiment about −100 to about −20° C. In one embodiment, the second refrigerant is ethylene which is at a pressure of about 10 psig and a temperature of about −94° C. The second refrigerant flowing through line 251 to compressor 244 may be at a pressure of about −10 to about 250 psig, and in one embodiment about 0 to about 50 psig; and a temperature of about −120 to about 0° C., and in one embodiment about −100 to about −20° C. In one embodiment, the second refrigerant is ethylene which is at a pressure of about 10 psig and a temperature of about −94° C. The second refrigerant flowing through line 252 to cooler 248 may be at a pressure of about 50 to about 500 psig, and in one embodiment about 100 to about 300 psig; and a temperature of about 50 to about 250° C., and in one embodiment about 100 to about 200° C. In one embodiment, the second refrigerant is ethylene which is at a pressure of about 270 psig and a temperature of about 121° C. The second refrigerant flowing through line 253 to condenser 242 may be at a pressure of about 50 to about 500 psig, and in one embodiment about 100 to about 300 psig; and a temperature of about −20 to about 100° C., and in one embodiment about 0 to about 50° C. In one embodiment, the second refrigerant is ethylene which is at a pressure of about 270 psig and a temperature of about 30° C. The second refrigerant flowing through line 254 to expansion device 246 may be at a pressure of about 50 to about 500 psig, and in one embodiment about 100 to about 300 psig; and a temperature of about −50 to about 0° C., and in one embodiment about −40 to about −10° C. In one embodiment, the second refrigerant is ethylene which is at a pressure of about 270 psig and a temperature of about −30° C. The second refrigerant flowing through line 255 to second heat exchanger 240 may be at a pressure of about −10 to about 250 psig, and in one embodiment about 0 to about 50 psig; and a temperature of about −120 to about 0° C., and in one embodiment about −100 to about −20° C. In one embodiment, the second refrigerant is ethylene which is at a pressure of about 270 psig and a temperature of about −94° C.

The product is cooled in third heat exchanger 270 using a third refrigerant which flows through a plurality of refrigerant microchannels in heat exchanger 270. The refrigerant microchannels in heat exchanger 270 are interleaved with the product microchannels in heat exchanger 270 to effect exchange of heat between the product microchannels and the refrigerant microchannels. This is discussed in greater detail below. The third refrigerant then flows from third heat exchanger 270 through line 280 to compressor 274, through compressor 274 to line 281, through line 281 to cooler 278, through cooler 278 to line 282, through line 282 to condenser 272, through condenser 272 to line 283, through line 283 to expansion device 276, through expansion device 276 to line 284, and through line 284 back into third heat exchanger 270. The third refrigerant may be any of the refrigerants discussed above. In one embodiment, the third refrigerant is methane. The third refrigerant flowing through line 280 to compressor 274 may be at a pressure of about −10 to about 250 psig, and in one embodiment about 0 to about 50 psig; and a temperature of about −180 to about −100° C., and in one embodiment about −160 to about −120° C. In one embodiment, the third refrigerant is methane which is at a pressure of about 11 psig and a temperature of about −154° C. The third refrigerant flowing through line 281 to cooler 278 may be at a pressure of about 50 to about 1000 psig, and in one embodiment about 200 to about 800 psig; and a temperature of about −100 to about 50° C., and in one embodiment about −50 to about 0° C. In one embodiment, the third refrigerant is methane which is at a pressure of about 480 psig and a temperature of about −16° C. The third refrigerant flowing through line 282 to condenser 272 may be at a pressure of about 50 to about 1000 psig, and in one embodiment about 200 to about 800 psig; and a temperature of about −100 to about 50° C., and in one embodiment about −50 to about 0° C. In one embodiment, the third refrigerant is methane which is at a pressure of about 480 psig and a temperature of about −25° C. The third refrigerant flowing through line 283 to expansion device 276 may be at a pressure of about 50 to about 1000 psig, and in one embodiment about 200 to about 800 psig; and a temperature of about −120 to about −50° C., and in one embodiment about −100 to about −70° C. In one embodiment, the third refrigerant is methane which is at a pressure of about 480 psig and a temperature of about −92° C. The third refrigerant flowing through line 284 to heat exchanger 270 may be at a pressure of about −10 to about 250 psig, and in one embodiment about 0 to about 50 psig; and a temperature of about −180 to about −100° C., and in one embodiment about −160 to about −120° C. In one embodiment, the third refrigerant is methane which is at a pressure of about 11 psig and a temperature of about −154° C.

Figure 10:
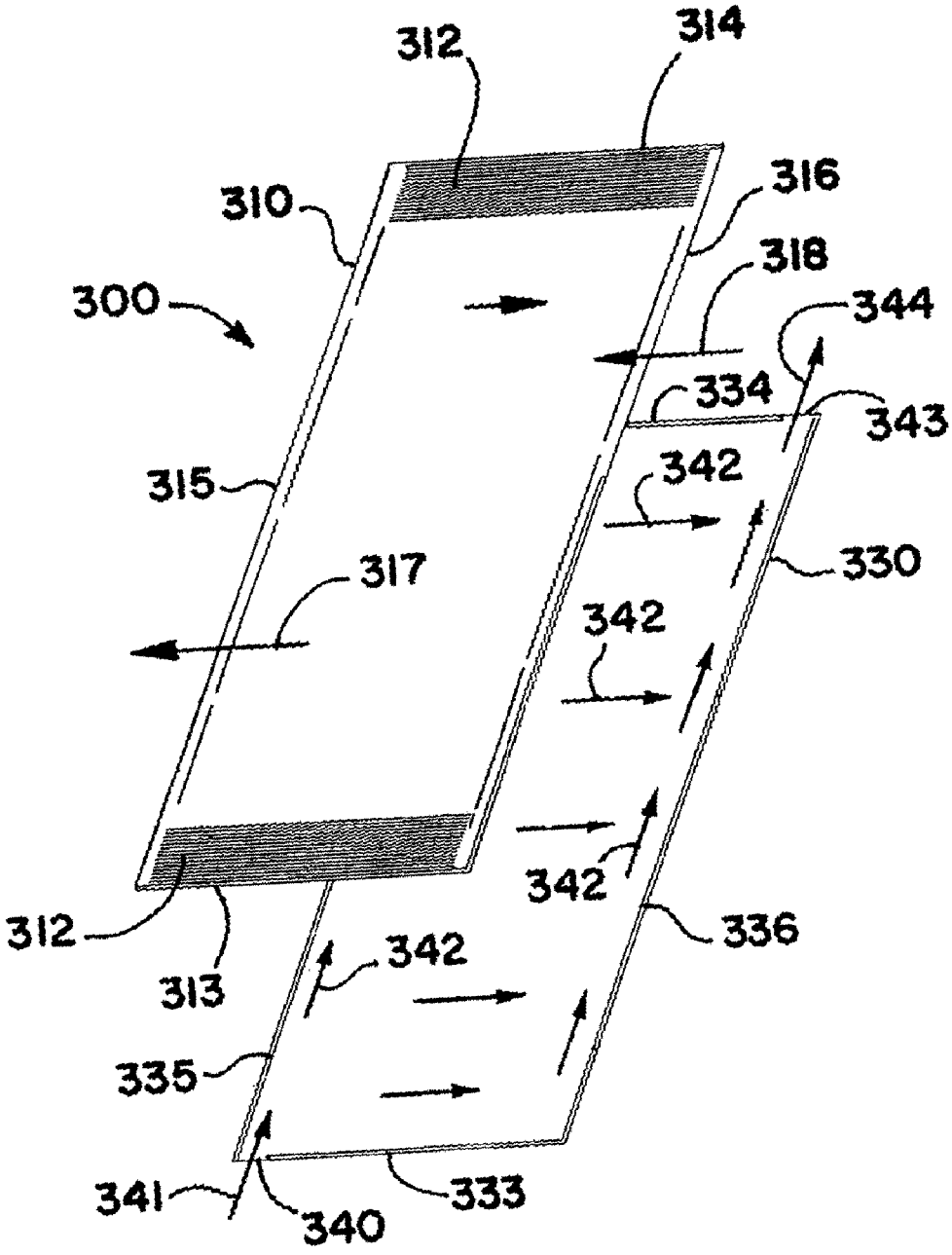
FIG. 10 is a schematic illustration showing an exploded view of microchannel layers used in an alternate embodiment of the heat exchanger that may be employed with the inventive process.

Each of the heat exchangers 210, 240 and 270 contain layers of product microchannels and refrigerant microchannels. The layers may be aligned one above another as illustrated in FIG. 10. Referring to FIG. 10, layers of microchannels are stacked one above another to provide a repeating unit 300 of microchannel layers which is comprised of microchannel layers 310 and 330. Microchannel layer 310 provides for the flow of refrigerant. Microchannel layer 330 provides for the flow of the product to be cooled or liquefied.

Microchannel layer 310 contains a plurality of microchannels 312 arranged in parallel and extending along the length of microchannel layer 310 from end 313 to end 314, each microchannel 312 extending along the width of microchannel layer 310 from one end 315 to the other end 316 of microchannel layer 310. The refrigerant entering these microchannels is typically in the form of a mixture of vapor and liquid, while the refrigerant exiting these microchannels is typically in the form of a vapor. The flow of refrigerant through these microchannels may be in the direction indicated by arrows 317 and 318. The Reynolds Number for the flow of vapor refrigerant through these microchannels may be up to about 10,000, and in one embodiment up to about 7000, and in one embodiment up to about 4000, and in one embodiment up to about 3000, and in one embodiment in the range of about 100 to about 2300, and in one embodiment about 200 to about 1800. The Reynolds Number for the flow of liquid refrigerant through these microchannels may be up to about 10,000, and in one embodiment up to about 7000, and in one embodiment up to about 4000, and in one embodiment up to about 3000, and in one embodiment up to about 2000, and in one embodiment up to about 1000, and in one embodiment up to about 500, and in one embodiment up to about 250, and in one embodiment about 5 to about 100, and in one embodiment about 8 to about 36. Each of the microchannels may have a cross section having any shape, for example, a square, rectangle, circle, semi-circle, etc. Each microchannel may have an internal height or gap of up to about 2 mm, and in one embodiment in the range of about 0.05 to about 2 mm, and in one embodiment about 0.2 to about 1 mm. The width of each of these microchannels may be of any dimension, for example, up to about 3 meters, and in one embodiment about 0.01 to about 3 meters, and in one embodiment about 0.1 to about 3 meters. The length of each microchannel may be of any dimension, for example, up to about 10 meters, and in one embodiment up to about 6 meters, and in one embodiment from about 0.5 to about 6 meters, and in one embodiment about 0.5 to about 3 meters, and in one embodiment about 0.5 to about 2 meters, and in one embodiment about 1 meter. In one embodiment the length may range from about 0.5 to about 10 meters, and in one embodiment from about 1 to about 6 meters, and in one embodiment from 1 to about 3 meters. The pressure drop for the flow of refrigerant through the microchannels may be up to about 30 psi/ft, and in one embodiment from about 0.1 to about 20 psi/ft, and in one embodiment from about 0.1 to about 5 psi, and in one embodiment about 0.1 to about 2 psi/ft.

Microchannel layer 330 contains a single microchannel 332 which extends along the length of microchannel layer 330 from end 333 to end 334, and along the width of microchannel layer 330 from one end 335 to the other end 336 of microchannel layer 330. The product to be cooled or liquefied enters microchannel 332 through entrance 340 as indicated by arrow 341, flows through microchannel 332 as indicated by arrows 342, and exits microchannel 332 through exit 343 as indicated by arrow 344. The flow of product through the microchannels may be laminar, in transition or turbulent. In one embodiment, the product entering the microchannels comprises a gas, and the product exiting these microchannels comprises a liquid. The Reynolds Number for the flow of gaseous product through the microchannels may be from about 2000 to about 30,000, and in one embodiment about 15,000 to about 25,000. The Reynolds Number for the flow of liquid product through the microchannels may be from about 1000 to about 10,000, and in one embodiment about 1500 to about 3000. Each of the microchannels may have a cross section having any shape, for example, a square, rectangle, circle, semi-circle, etc. Each of these microchannels may have an internal height of up to about 2 mm, and in one embodiment in the range of about 0.05 to about 2 mm, and in one embodiment about 0.3 to about 0.7 mm. The width of each of these microchannels as measured from side 333 to side 334 may be of any dimension, for example, up to about 3 meters, and in one embodiment from about 0.01 to about 3 meters, and in one embodiment about 1 to about 3 meters. The length of each of the microchannels 332 as measured from side 335 to side 336 may be of any dimension, for example, up to about 10 meters, and in one embodiment up to about 6 meters, and in one embodiment from about 0.5 to about 6 meters, and in one embodiment about 0.5 to about 2 meters, and in one embodiment about 1 meter. In one embodiment the length may range from about 0.5 to about 10 meters, and in one embodiment from about 1 to about 6 meters, and in one embodiment from 1 to about 3 meters. The pressure drop for the flow of product through the microchannels may be up to about 30 psi/ft, and in one embodiment from about 0.1 to about 30 psi/ft, and in one embodiment from about 0.1 to about 10 psi/ft, and in one embodiment about 0.1 to about 5 psi/ft.

The number of microchannels in each of the microchannel layers 310 and 330 may be any desired number, for example, one, two, three, four, five, six, eight, ten, hundreds, thousands, tens of thousands, hundreds of thousands, millions, etc. Similarly, the number of repeating units 300 of microchannel layers may be any desired number, for example, one, two, three, four, six, eight, ten, tens, hundreds, thousands, etc. Header and footer manifolds along with associated valves and the like may be used with the microchannels to provide for flow of product or refrigerant to and from the microchannels.

Figure 20:
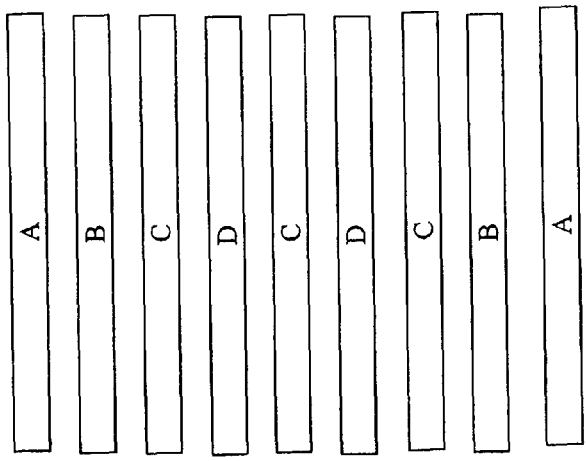
FIG. 20 is a schematic illustration showing a sequence of microchannels for use in a four-stream heat exchanger that may be used with the inventive process.

The heat exchanger may be a four-stream heat exchanger. An example of a four-stream heat exchanger is illustrated in FIG. 20 which shows an arrangement of microchannels for different streams (i.e., streams A, B, C and D) in a repeating unit for the four-stream heat exchanger.

In one embodiment, the inventive process includes additional heat exchangers such as pre-coolers, post-coolers, refrigerant conditioning components (e.g., heating, cooling, component feeding/separating, etc.), and the like, for processing the product stream. These additional heat exchangers may be up stream and/or down stream of the heat exchanger used with the inventive process. These additional heat exchangers may be of conventional design. In one embodiment, one or more of the fluid streams in such additional heat exchangers flows through a set of microchannels. In processes employing more than one microchannel heat exchanger, the additional heat exchanger may be positioned between the microchannel heat exchanger. For example, in referring to FIG. 9, an additional heat exchanger of conventional design (i.e., not a microchannel heat exchanger) or heat exchanger employing microchannels for only one stream (i.e., either the refrigerant or product stream) may be positioned between microchannel heat exchangers 210 and 240, or between microchannel heat exchangers 240 and 270.

Figure 11:
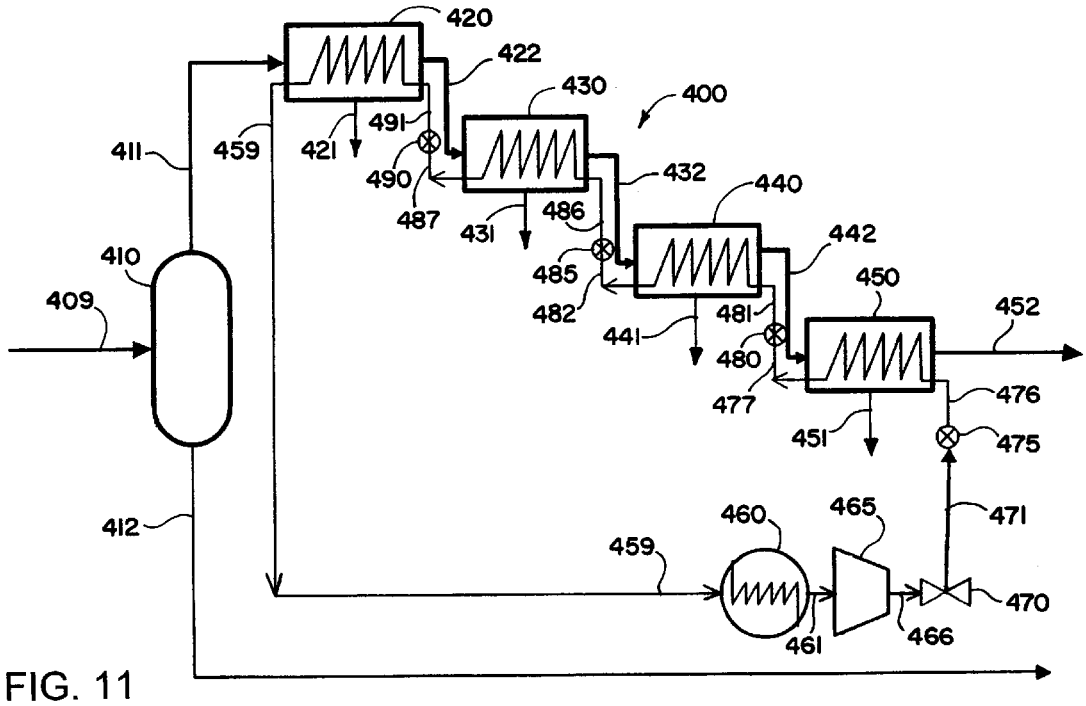
FIG. 11 is a flow sheet illustrating a separation system using microchannel heat exchangers for separating water, butanes or butylenes, propanes or propylenes, and ethane or ethylene from raw natural gas.

The inventive process may be combined with a separation system that utilizes heat exchangers, condensers, evaporators, and the like, including microchannel heat exchangers, condensers, evaporators, etc., to separate out undesirable components from the product. For example, a separation system may be used to separate water and higher molecular weight hydrocarbons from raw natural gas prior to liquefying natural gas using the inventive process. One such system is illustrated in FIG. 11. The separation system illustrated in FIG. 11 involves the use of a series of cascaded microchannel heat exchangers or condensers for separating water and higher molecular weight materials such as ethane or ethylene, propanes or propylene, and butanes or butylene, from the raw natural gas. This system may also employ other mechanisms to separate liquids, such as capillary suction/transportation and capture meshes in channels sandwiched between the channels of the microchannel heat exchangers. Referring to FIG. 11, separation system 400 includes the use of bulk liquids separator 410, microchannel heat exchangers or condensers 420, 430, 440 and 450, condenser 460, compressor 465, valve 470, and expansion devices 475, 480, 485 and 490. Each of the heat exchangers or condensers 420, 430, 440 and 450 is a two stream heat exchanger or condenser similar in design and operation to the heat exchangers 210, 240 and 270 discussed above. A raw natural gas product mixture comprising methane, water and hydrocarbons containing two or more carbon atoms, enters bulk liquids separator 410 through line 409. Hydrocarbons of about 5 carbon atoms and above are separated from the raw natural gas product mixture and advanced to storage or further processing through line 412. The remainder of the raw natural gas product mixture containing water and hydrocarbons of 1 to about 4 carbon atoms is advanced through line 411 to microchannel heat exchanger 420. Water is separated from the product mixture in heat exchanger 420 and is removed from heat exchanger 420 through line 421. The remainder of the raw natural gas product mixture flows through line 422 to microchannel heat exchanger 430. Butanes and butylenes are separated from the natural gas product mixture in heat exchanger 430 and flow from heat exchanger 430 through line 431. The remainder of the raw natural gas product mixture flows through line 432 to microchannel heat exchanger 440 where propanes and propylene are separated from the product mixture. Propanes and propylene flow from the heat exchanger 440 through line 441. The remainder of the product mixture flows through line 442 to microchannel heat exchanger 450. In microchannel heat exchanger 450 ethane and ethylene are separated from the product mixture and flow from heat exchanger 450 through line 451. The remaining product comprises methane which flows from condenser 450 through line 452. The methane flowing through line 452 may enter the process illustrated in FIG. 1 through line 28, or the process illustrated in FIG. 9 through line 209. The raw natural gas product mixture flowing through line 409 to bulk liquids separator 410 may be at a pressure of about 10 to about 5000 psig, and in one embodiment about 10 to about 2500 psig; and a temperature of about −250 to about 500° C., and in one embodiment about −50 to about 300° C. The product mixture flowing through line 411 to heat exchanger 420 may be at a pressure of about 10 to about 5000 psig, and in one embodiment about 10 to about 2500 psig; and a temperature of about −250 to about 500° C., and in one embodiment about −50 to about 300° C. The product mixture flowing through line 422 to heat exchanger 430 may be at a pressure of about 10 to about 5000 psig, and in one embodiment about 10 to about 2500 psig; and a temperature of about −250 to about 500° C., and in one embodiment about −200 to about 300° C. The product mixture flowing through line 432 to heat exchanger 440 may be at a pressure of about 10 to about 5000 psig, and in one embodiment about 10 to about 2500 psig; and a temperature of about −225 to about 500° C., and in one embodiment about −200 to about 300° C. The product mixture flowing through line 442 to heat exchanger 450 may be at a pressure of about 10 to about 5000 psig, and in one embodiment about 10 to about 2500 psig; and a temperature of about −245 to about 500° C., and in one embodiment about −200 to about 300° C. The methane flowing from heat exchanger 450 through line 452 may be at a pressure of about 10 to about 5000 psig, and in one embodiment about 10 to about 2500 psig; and a temperature of about −245 to about 300° C., and in one embodiment about −200 to about 300° C.

The refrigerant used in the separation system 400 illustrated in FIG. 11 may be any of the refrigerants discussed above. The refrigerant flows through line 459 to condenser 460, through condenser 460 to line 461, through line 461 to compressor 465, through compressor 465 to line 466, through line 466 to valve 470, through valve 470 to line 471, through line 471 to expansion device 475, through expansion device 475 to line 476, through line 476 to heat exchanger 450, through heat exchanger 450 to line 477, through line 477 to expansion device 480, through expansion device 480 to line 481, through line 481 to heat exchanger 440, through heat exchanger 440 to line 482, through line 482 to expansion device 485, through expansion device 485 to line 486, through line 486 to heat exchanger 430, through heat exchanger 430 to line 487, through line 487 to expansion device 490, through expansion device 490 to line 491, through line 491 to heat exchanger 420, through heat exchanger 420 to line 459, and through line 459 back to condenser 460 where the cycle starts all over again. The refrigerant flowing through line 459 from microchannel heat exchanger 420 to condenser 460 may be at a pressure of about 10 to about 3000 psig, and in one embodiment about 20 to about 2500 psig; and a temperature of about −250 to about 300° C., and in one embodiment about −225 to about 300° C. The refrigerant flowing through line 461 from condenser 460 to compressor 465 may be at a pressure of about 10 to about 3000 psig, and in one embodiment about 20 to about 2500 psig; and a temperature of about −250 to about 300° C., and in one embodiment about −225 to about 300° C. The refrigerant flowing through line 466 from compressor 465 to valve 470 may be at a pressure of about 10 to about 3000 psig, and in one embodiment about 20 to about 2500 psig; and a temperature of about −250 to about 300° C., and in one embodiment about −225 to about 300° C. The refrigerant flowing through line 471 from valve 470 to expansion device 475 may be at a pressure of about 10 to about 3000 psig, and in one embodiment about 20 to about 2500 psig; and a temperature of about −250 to about 300° C., and in one embodiment about −225 to about 300° C. The refrigerant flowing through line 476 from expansion device 475 to heat exchanger 450 may be at a pressure of about 10 to about 3000 psig, and in one embodiment about 20 to about 2500 psig; and a temperature of about −250 to about 300° C., and in one embodiment about −225 to about 300° C. The refrigerant flowing through line 477 from heat exchanger 450 to expansion device 480 may be at a pressure of about 10 to about 3000 psig, and in one embodiment about 20 to about 2500 psig; and a temperature of about −250 to about 300° C., and in one embodiment about −225 to about 300° C. The refrigerant flowing through line 481 from expansion device 480 to heat exchanger 440 may be at a pressure of about 10 to about 3000 psig, and in one embodiment about 20 to about 2500 psig; and a temperature of about −250 to about 300° C., and in one embodiment about −225 to about 300° C. The refrigerant flowing through line 482 from heat exchanger 440 to expansion device 485, may be at a pressure of about 10 to about 3000 psig, and in one embodiment about 20 to about 2500 psig; and a temperature of about −250 to about 300° C., and in one embodiment about −225 to about 300° C. The refrigerant flowing through line 486 from expansion device 485 to heat exchanger 430 may be at a pressure of about 10 to about 3000 psig, and in one embodiment about 20 to about 2500 psig; and a temperature of about −250 to about 300° C., and in one embodiment about −225 to about 300° C. The refrigerant flowing through line 487 from heat exchanger 430 to expansion device 490 may be at a pressure of about 10 to about 3000 psig, and in one embodiment about 20 to about 2500 psig; and a temperature of about −250 to about 300° C., and in one embodiment about −225 to about 300° C. The refrigerant flowing through line 491 from expansion device 490 to heat exchanger 420 may be at a pressure of about 10 to about 3000 psig, and in one embodiment about to about 2500 psig; and a temperature of about −250 to about 300° C., and in one embodiment about −225 to about 300° C.

The refrigerant and product microchannels used in the heat exchangers used in the inventive process may be constructed of a material comprising a metal (e.g, stainless steel or other steel alloys), ceramics, polymer (e.g., a thermoset resin), or a combination thereof. A useful material is the iron-nickel alloy INVAR which contains in excess of about 36% nickel. These materials provide thermal conductivities that are sufficient to provide the necessary requirements for overall heat transfer coefficients. An advantage of using these materials is that inefficiencies due to axial conduction are significantly reduced as compared to using high thermal conductive materials such as aluminum. This permits the use of relatively short microchannels in the heat exchangers. Thus, although the microchannels may be constructed of a high thermal conductive material such as aluminum, an advantage of the inventive process is that it is not necessary to use such materials.

As a heat exchanger used for liquefying natural gas is operated at very low temperature (i.e., less than about −100° C.) and experiences large temperature gradients, to build a microchannel heat exchanger it is necessary to use materials which are compatible with the conditions of low temperature and high temperature gradient. The material used should have a low coefficient of thermal expansion (CTE) and a medium thermal conductivity. The low CTE value insures minimal deformation of channel dimensions during operation due to temperature gradients within the heat exchanger by keeping low thermal stress level. Materials with low CTE values are more resistant to dimensional changes during fabrication. In microchannel heat exchangers, in lieu of the small channel dimensions a tight dimension tolerance is required, as any stack-up of dimension mismatches due to thermal expansion, contraction or fabrication tolerance will cause flow mal-distribution and extra thermal stress. Medium thermal conductivity is required for minimizing the longitudinal heat conduction that deteriorates heat exchanger effectiveness. On the other hand, sufficient mechanical strength and corrosion-resistant features at very low temperature are desired for liquefied natural gas microchannel heat exchangers. In one embodiment, the alloy INVAR meets these requirements. INVAR does not experience significant thermal expansion in the extremely low temperature environment (i.e., less than about −163° C.) or in a room temperature environment. INVAR has a low thermal expansion coefficient, which makes it appropriate for precision machining. The nickel content enhances its corrosion resistance. The level of thermal conductivity around 10 W/m-K makes it a suitable heat exchanger material for a very low longitudinal heat conduction and in turn a high performance effectiveness in microchannel heat exchangers.

In one embodiment, the stack up of fabrication tolerances may exacerbate flow maldistribution between parallel microchannels. For example, if one set of microchannels (nominal flow gap of 0.5 mm as defined by the drawing specifications) has an actual flow gap (defined as the distance between adjacent walls for an interleaved heat exchanger) of 0.55 mm while a second set of microchannels on a different layer in the stacked device has an actual flow gap of 0.45 mm, the net effect is an increase in flow of more than 10% to the larger actual gap channels. In one embodiment, a maximum mismatch of flow of less than about 30% between at least 90% of all like microchannels is desired to obtain low pressure drop in heat exchanger used with the inventive process.

With the inventive process, it is possible to use large numbers of microchannels operating in parallel (to obtain relatively high surface areas) that are relatively short in length to minimize pressure drop. These microchannels may provide high heat transfer coefficients (since the Nusselt number is the same, but the hydraulic diameter is lower) and low pressure drops as compared to conventional cryogenic liquefication systems.

Figure 12:
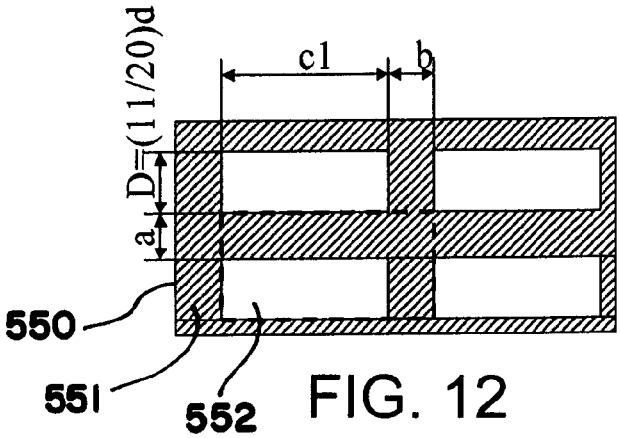
FIGS. 12–14 are cross-sectional views of portions of heat exchanger cores containing microchannels useful with the inventive process. The microchannels illustrated in FIG. 12 are rectangular in shape. The microchannels illustrated in FIG. 13 are circular in shape. The microchannels illustrated in FIG. 14 are semicircular in shape.
Figure 13:
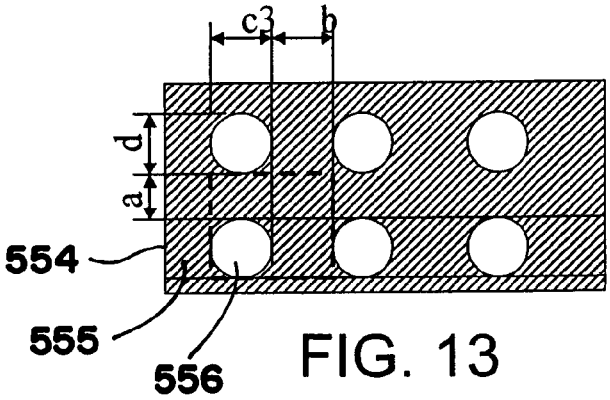
Figure 14:
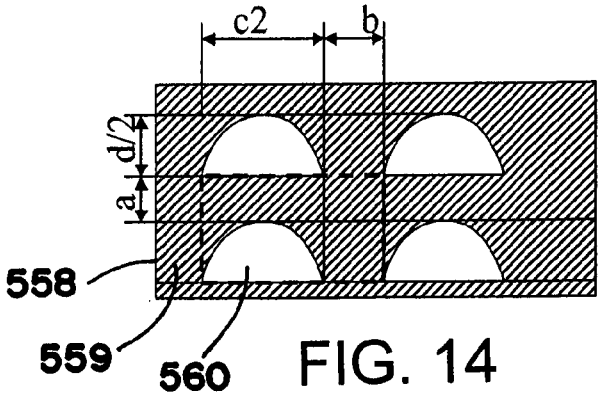

The microchannel heat exchangers used with the inventive process may have relatively high ratios of fluid microchannel volume (i.e., refrigerant and product microchannel volumes) to heat exchanger volume. This feature allows for a high heat transfer density per unit weight of heat exchanger. This is illustrated in FIGS. 12–14. FIGS. 12–14 illustrate cross sections of parts of heat exchanger cores useful with the inventive process. Heat exchanger core 550 (FIG. 12) includes heat exchanger wall 551 and rectangular microchannel 552. Heat exchanger core 554 (FIG. 13) includes heat exchanger wall 555 and circular microchannel 556. Heat exchanger core 558 (FIG. 14) includes heat exchanger wall 559 and semicircular microchannel 560. Repeating units for each heat exchanger core are indicated in FIGS. 12–14 by dashed lines. Assuming the cross sectional configuration and dimensions are unchanged in the flow direction, for the same hydraulic diameter d, rib width b=d/2 and web thickness a=d/2, the rectangular microchannel (FIG. 12) of an aspect ratio c1/D=10 has a ratio of channel volume to heat exchanger volume RCVHEV=c1*D/(c1*D+c1*a+D*b+a*b)=121/252=0.48; the semi-circular microchannel (FIG. 14) has a RCVHEV=3.1415926/12=0.26; and the circular microchannel (FIG. 13) has a RCVHEV=3.1415926/9=0.35. This relation between the geometries also holds for different web thickness and rib widths. Thus, while the microchannels used in the heat exchangers for the inventive process may have any configuration, the larger aspect ratios provided by rectangular microchannels renders such microchannels advantageous for providing high heat transfer efficiencies and low pressure drop. In one embodiment, the heat exchanger used with the inventive process has a microchannel volume to heat exchanger volume ratio of at least about 0.2, and in one embodiment at least about 0.25, and in one embodiment at least about 0.3, and in one embodiment at least about 0.35, and in one embodiment at least about 0.4, and in one embodiment at least about 0.45.

Figure 5:
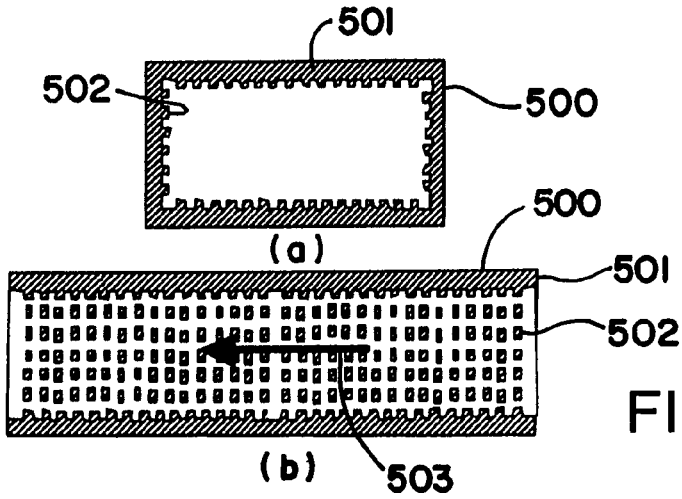
FIGS. 5(*a*) and 5(*b*) are schematic illustrations of a microchannel with micro-scale structures formed on its interior surface, the micro-scale structures being corrugated shaped structures.
Figure 6:
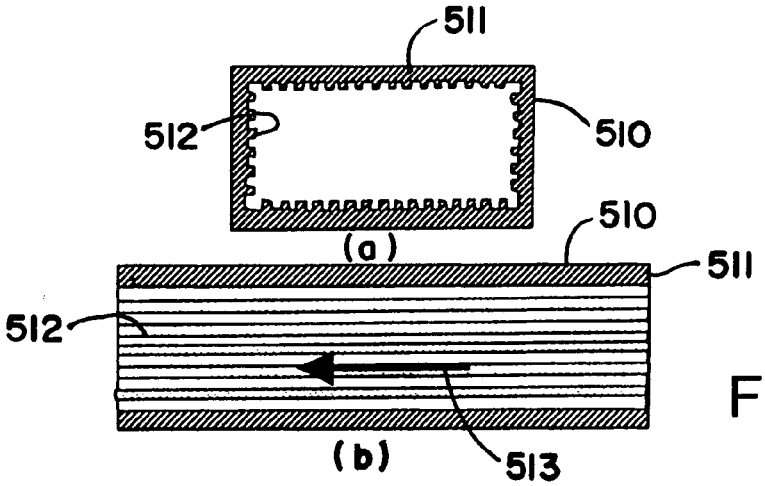
FIGS. 6(*a*) and 6(*b*) are schematic illustrations of a microchannel with micro-scale structures formed on its interior surface, the micro-scale structures being longitudinal groves.

Micro-scale structures may be formed on the interior surfaces of the refrigerant microchannels. These micro-scale structures provide for increased heat transfer areas. The micro-scale structures include: grooves, corrugations, porous layers, reentrant openings, meshes, etc. Some of these are illustrated in FIGS. 5–8. In FIGS. 5(*a*), 5(*b*), 7 and 8 microchannel 500 has a rectangular cross-section (FIG. 5(*a*) and 8) with corrugated shaped structures 502 formed on the interior surface of channel wall 501. Fluid flows through microchannel 500 in the direction indicated by arrow 503 (FIG. 5(*b*)). Vapor bubble 522 (FIG. 8) may form during fluid flow. In FIGS. 6(*a*) and 6(*b*) microchannel 510 has a rectangular cross section (FIG. 6(*a*)) with longitudinal grooves 512 formed on the interior surface of microchannel wall 511. Fluid flows through the microchannel 510 in the direction indicated by directional arrow 513 (FIG. 6(*b*)). Methods for forming the micro structures include, but are not limited to: machining, laser drilling, microelectro machining systems (MEMS), lithography electrodeposition and molding (LIGA), electrical sparkling, electrochemical etching, powder slurry coating, and oxidation (e.g., heat treatment).

Figure 7:
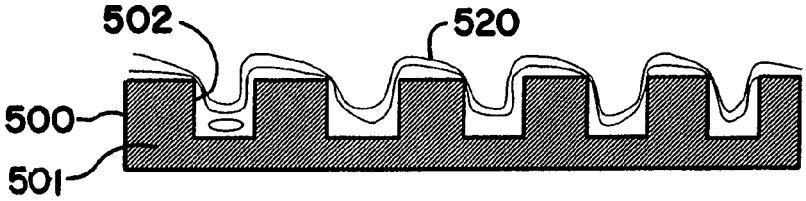
FIG. 7 is a schematic illustration of a wall of a microchannel with micro-scale structures formed on the wall. A thermal boundary is shown overlying the wall and the micro-scale structures.

Micro-scale structured surfaces provide a number of advantages. For example, as illustrated in FIG. 7, with single phase flow microchannels, a corrugated surface breaks down the development of thermal boundary layer 520 in laminar flow, forms a zone of large temperature gradient (thinned boundary layer) and in turn enhances the mass and heat transfer process. In turbulent flow regime, this structure increases the turbulent mixing.

Figure 8:
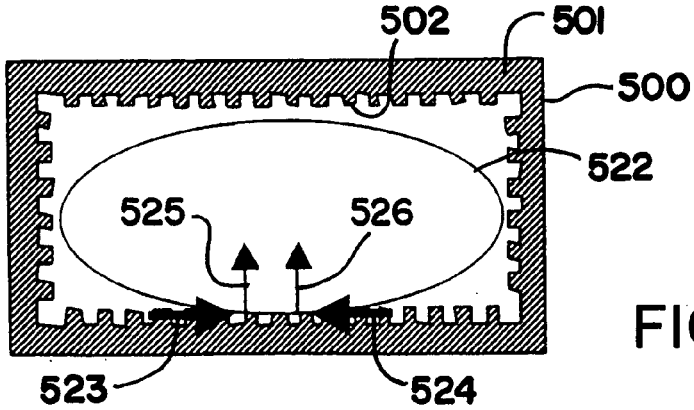
FIG. 8 is a cross-sectional view of a microchannel with micro-scale structures formed on its interior. A vapor bubble is shown as being positioned within the microchannel.

Micro-scale structured surfaces help counteract flow boiling problems. Flow boiling occurs when refrigerants evaporate in channels. This leads to the formation of vapor bubbles on the surface of the channel. This leads to the formation of hot spots due to dryout of a thin liquid film that forms underneath the vapor bubble. A significant reduction in heat transfer may thereby result. A microchannel with micro-scale structures on its surface reduces the chance of dry out as a result of enhanced liquid supply to the bubble bottom. This is shown in FIG. 8. The microstructure of the corrugations increases the liquid flow towards the bottom of vapor bubble 522 by capillary force as indicated by arrows 523 and 524. The protrusive structure increases the solid wall area underneath the bubble 522 and in the contact area with the liquid, as such evaporation as indicated by arrows 525 and 526 is more efficient than with a smooth surface. Thus, the overall heat transfer is significantly enhanced with the use of micro-scale structures on the surfaces of the microchannels. This enables the use of relatively close temperature approaches between hot and cold streams in the heat exchanger.

Figure 15:
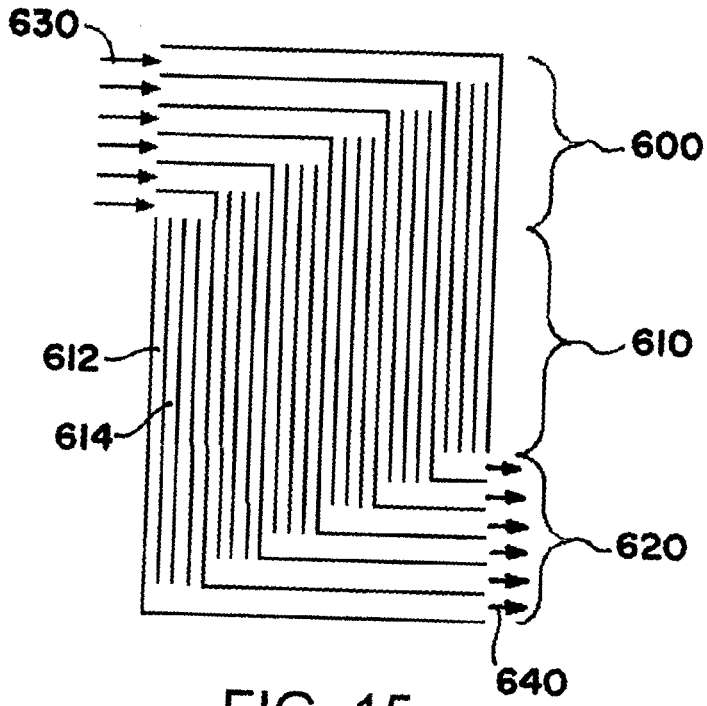
FIG. 15 is a schematic illustration showing a series of sub-manifolds for supplying refrigerant and product to microchannels within a heat exchanger, and for removing product and refrigerant from the microchannels.

In one embodiment, the heat exchanger used with the inventive process employs a series (that is, two or more) of sub-manifolds for supplying refrigerant and product to the microchannels within the heat exchangers and for removing product and refrigerant from the microchannels. This is illustrated in FIG. 15. Referring to FIG. 15, header sub-manifolds 600 are connected to microchannels (i.e., refrigerant microchannels 612 and product microchannels 614) in the main heat exchange zone 610. The microchannels in turn are connected to footer sub-manifolds 620. Refrigerant and product flow through the header sub-manifolds 600, as indicated by directional arrows 630, then through the microchannels 612 and 614 in the main heat exchange zone 610, and then exit the heat exchanger through footer sub-manifolds 620, as indicated by directional arrows 640.

Figure 16:
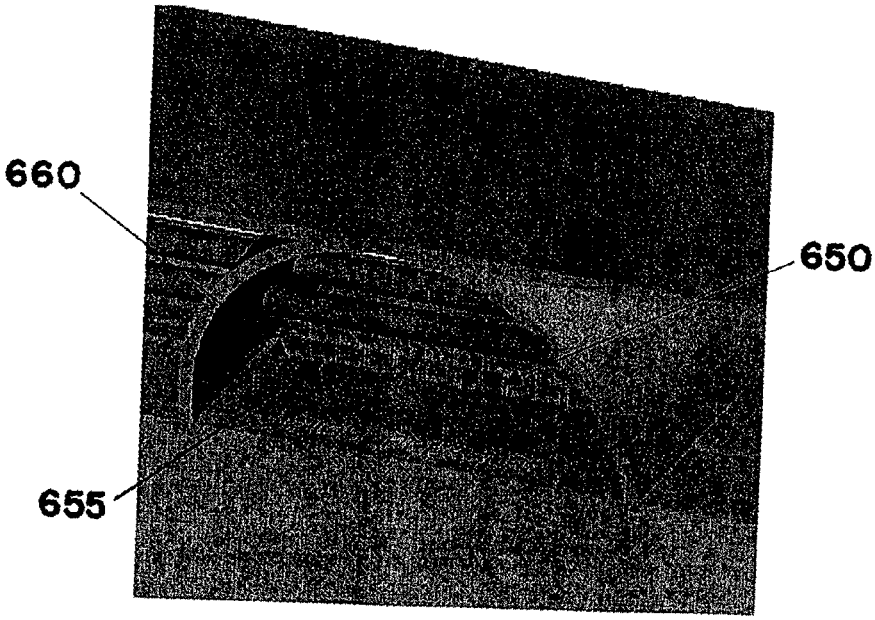
FIG. 16 is a schematic illustration of a manifold header that is useful with the heat exchanger used with the inventive process.

Uniform distribution of two-phase (i.e., liquid-vapor) flow to the microchannels is sometimes problematic due to the difference in momentum of flow for the liquid and vapor. Low density vapor moves faster than liquid of higher density in a liquid-vapor mixture. This problem may be overcome by mixing the liquid and vapor in the header manifold or in the microchannels. The mixing may be effected in the header manifold as illustrated in FIG. 16. Referring to FIG. 16, liquid 650 is sprayed into the vapor phase 655 to provide for a two-phase mixture just above the channels 660.

Figure 17:
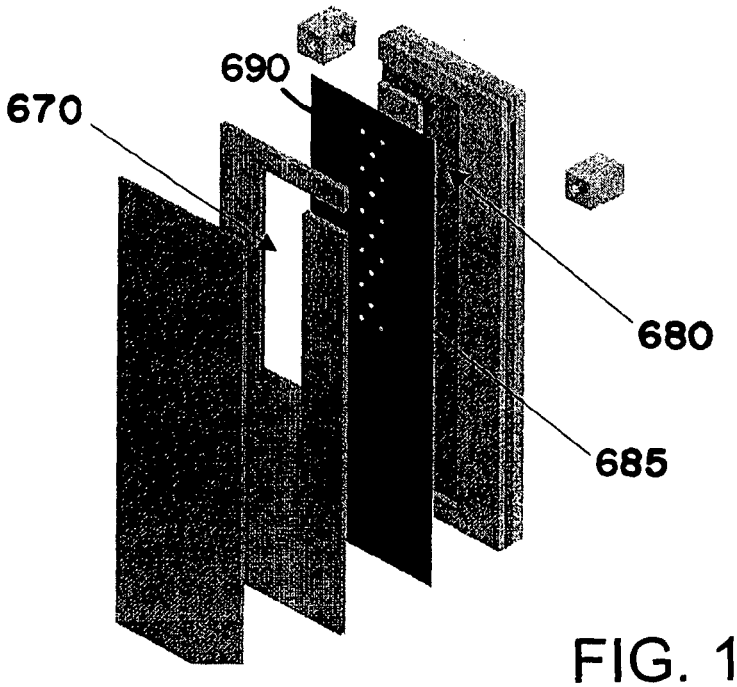
FIGS. 17–19 are schematic illustrations showing the mixing of a liquid with a vapor within microchannels of a heat exchanger used with the inventive process.
Figure 18:
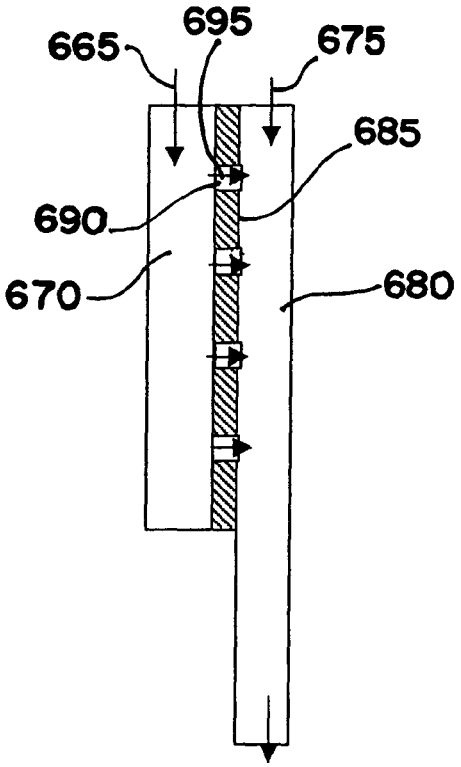
Figure 19:
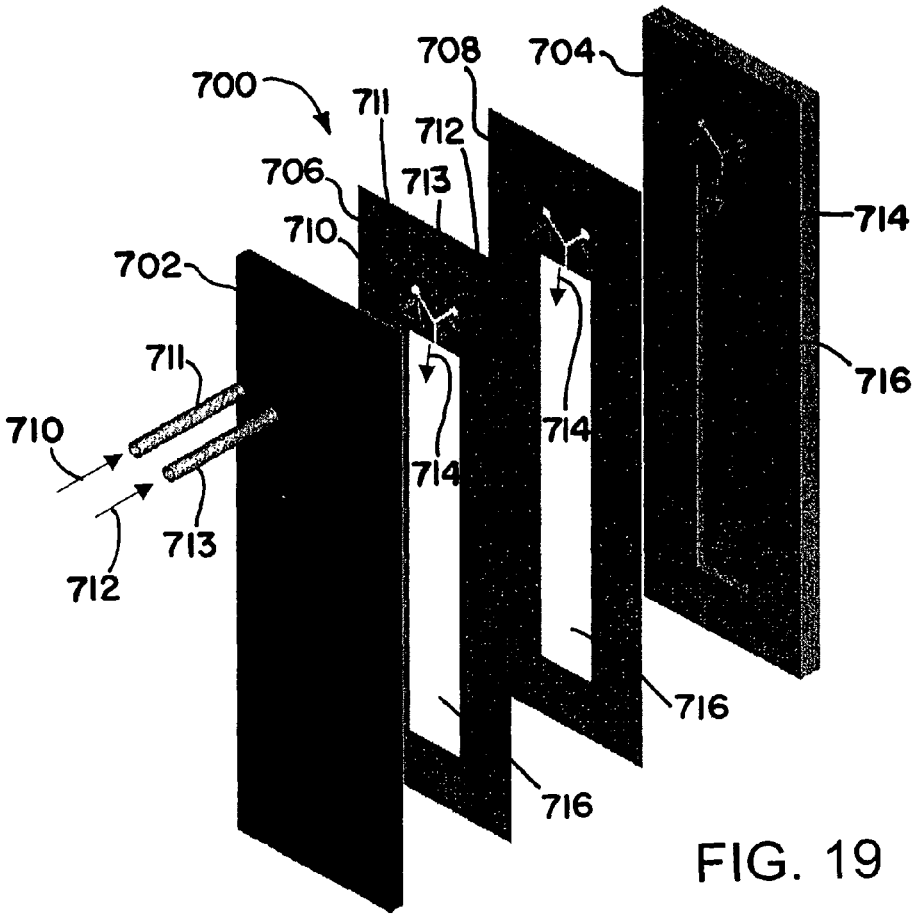

Alternatively, the liquid and vapor can be mixed inside the microchannels to create a two-phase mixture. This is illustrated in FIGS. 17–19. Referring to FIGS. 17 and 18, liquid 665 enters liquid channel 670, and vapor 675 enters vapor channel 680. Channels 670 and 680 are separated by orifice plate 685 which contains orifices 690. The liquid 665 flows through orifices 690 in orifice plate 685, as indicated by arrows 695, and enters the vapor channel 680 as a sprayed or dispersed liquid and mixes with the vapor 675.

The microchannel 700 illustrated in FIG. 19 is made from plates 702 and 704, and shims 706 and 708. Liquid 710 flows through line 711, and vapor 712 flows through line 713. The liquid and vapor are mixed to form liquid-vapor mixture 714 as the mixture enters channel 716.

The term "interstream planar heat transfer area percent" (IPHTAP) relates to the highest effective heat transfer area for the heat exchanger and refers to the surface area that separates two streams or fluids (e.g., the product and refrigerant streams), exchanging heat in a microchannel device, excluding ribs, fins, and surface area enhancers, as a percent of the total interior surface area of a channel that also includes ribs, fins, and surface area enhancers. Surface enhancers are defined as features with critical dimensions greater than one-tenth the minimum dimension of the channel. That is, the ratio of the area through which heat is transferred to neighboring channels with a different fluid flowing through to the total surface area of the channel. A geometry with IPHTAP=100% would signify that all available area is utilized for exchanging heat with neighboring different streams. IPHTAP may be calculated using the formula $$IPHTAP = \frac{\text{Area on channel perimeter through which heat is transferred to different streams}}{\text{Total surface area in the channel}} \times 100$$

In one embodiment, the IPHTAP for any stream in the heat exchanger (e.g., refrigerant microchannels (for example, low pressure refrigerant or high pressure refrigerant) or product microchannels) used with inventive process is at least about 20%, and in one embodiment at least about 30%, and in one embodiment at least about 40%, and in one embodiment at least about 50%, and in one embodiment at least about 70%, and in one embodiment at least about 90%.

In one embodiment, the volumetric heat flux for the heat exchanger 18 is at least about 0.5 watts per cubic centimeter ($W/cm^3$), and in one embodiment at least about 0.75 $W/cm^3$, and in one embodiment at least about 1.0 $W/cm^3$, and in one embodiment at least about 1.2 $W/cm^3$, and in one embodiment at least about 1.5 $W/cm^3$. The term volumetric heat flux refers to the heat gained by the refrigerant flowing through the microchannels divided by the core volume of the heat exchanger. The core volume of the heat exchanger includes all the streams of the heat exchanger and all the structural material that separates the streams from each other, but does not include the structural material separating streams from the outside. Therefore, the core volume ends on the edge of the outermost streams in the heat exchanger. The core volume does not include manifolding.

In one embodiment, the effectiveness of the heat exchanger used with the inventive process is at least about 0.8, and in one embodiment at least about 0.9, and in one embodiment at least about 0.95, and in one embodiment at least about 0.98, and in one embodiment at least about 0.985, and in one embodiment at least about 0.99, and in one embodiment at least about 0.995, with the microchannels having lengths of up to about 3 meters, and in one embodiment up to about 2 meters, and in one embodiment up to about 1 meter. The effectiveness of a heat exchanger is a measure of the amount of heat that is transferred divided by the maximum amount of heat that can be transferred. The effectiveness of the heat exchanger can be calculated from the formula $$\varepsilon = \frac{H_{ip} - H_{op}}{H_{ip} - H_{ilpr}}$$

wherein:

$\epsilon$ is the effectiveness of the heat exchanger;

$H_{ip}$ is the inlet enthalpy of the product to be cooled or liquefied;

$H_{op}$ is the outlet enthalpy of the product to be cooled or liquefied; and $H_{ilpr}$ is the enthalpy of the product at the low pressure refrigerant inlet temperature.

In one embodiment, the product to be cooled or liquefied is cooled from a temperature in the range of about −40° C. to about 40° C., and in one embodiment about −40° C. to about 32° C., to a temperature in the range of about −140° C. to about −160° C., and in one embodiment about −140° C. to about −155° C., and the rate of flow of such product is at least about 1500 pounds of product per hour per cubic meter ($lbs/hr/m^3$) of the core volume of the heat exchanger, and in one embodiment at least about 2500 $lbs/hr/m^3$. The total pressure drop for the refrigerant through the microchannels in the heat exchanger may be up to about 30 psi, and in one embodiment up to about 20 psi, and in one embodiment up to about 10 psi, and in one embodiment up to about 5 psi, and in one embodiment up to about 3 psi.

In one embodiment, the coefficient of performance for the heat exchanger is at least about 0.5, and in one embodiment at least about 0.6, and in one embodiment at least about 0.65, and in one embodiment at least about 0.68. The coefficient of performance is the enthalpy change for the product flowing through the microchannels divided by the compressor power required to make up for the pressure drop resulting from the flow of refrigerant through the microchannels.

The approach temperature for the heat exchanger may be up to about 50° C., and in one embodiment up to about 30° C., and in one embodiment up to about 20° C., and in one embodiment up to about 10° C., and in one embodiment up to about 5° C. The approach temperature may be defined as the difference between the temperature of the product to be cooled or liquefied exiting the heat exchanger and the temperature of the coldest refrigerant stream entering the heat exchanger.

In one embodiment, the temperature change in the product microchannel walls is at least about 25° C. per meter of length in the direction of product flow, and in one embodiment at least about 50° C. per meter, and in one embodiment at least about 75° C. per meter, and in one embodiment at least about 100° C. per meter.

An advantage of using the microchannel heat exchanger used with the inventive process is that the microchannel heat exchanger can be fabricated using materials and bonding techniques that permits operation of the heat exchanger at internal differential pressures of up to about 5000 psig or more. In one embodiment, the pressure of the refrigerant stream, product stream, or both the refrigerant and product streams may be in excess of about 1500 psig, and in one embodiment in excess of about 1750 psig, and in one embodiment in excess of about 2000 psig, and in one embodiment in excess of about 2250 psig.

Figure 21:
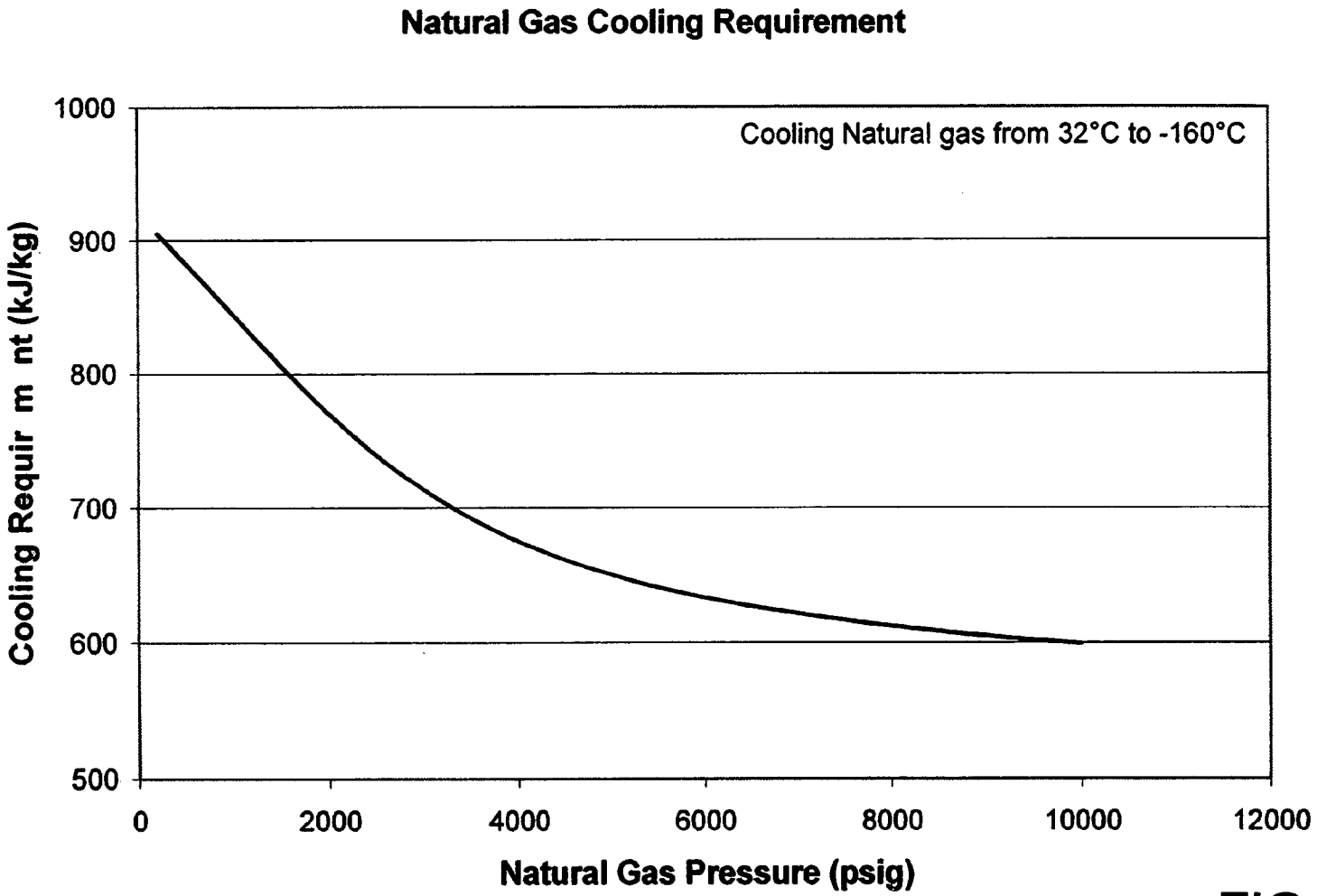
FIG. 21 is a graph comparing cooling requirements to pressure for natural gas.

The cooling requirement for condensing gases, including natural gas, decreases with increases in pressure. At higher pressures, these gases require less cooling for a given temperature change. This is shown in FIG. 21 wherein the cooling requirement for natural gas (approximated by methane) is plotted. The reduction in the cooling requirement for condensing gases such as natural gas at higher pressures results in a decrease in the requirement for refrigerant flow rate. The refrigerant flow rate is proportional to compressor operating costs, and thus a decrease in compressor operating cost can be achieved at higher product gas pressures. Thus, an advantage offered by the microchannel heat exchanger used with the inventive process is that product gas (e.g., natural gas) may be cooled at pressures of up to about 5000 psig or more, and in one embodiment from about 500 to about 5000 psig, and in one embodiment about 1000 to about 5000 psig, and in one embodiment about 1500 to about 5000 psig, and in one embodiment about 2000 to about 5000 psig.

EXAMPLE 1

Figure 22:
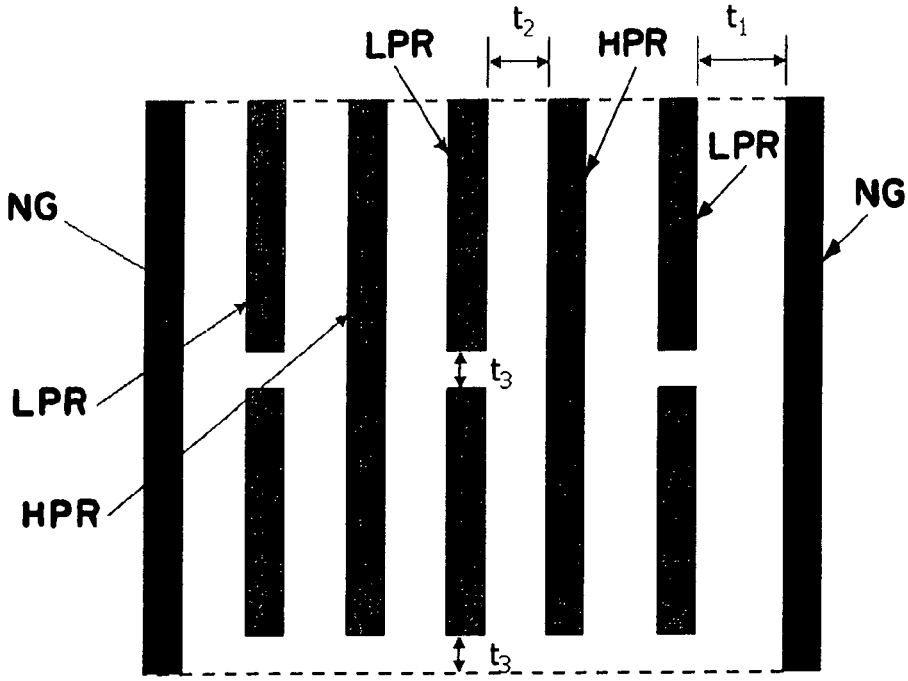
FIGS. 22 and 23 are schematic illustrations showing the sequence of microchannels used in the heat exchanger described in Example 1.

Natural gas pressure is increased up to 2500 psig and the reduction in refrigerant flow rate (with same operating conditions) to achieve same the outlet temperature of natural gas is estimated. The natural gas pressures are 635, 1000, 1500, 2000, and 2500 psig. As the natural gas pressure is increased, the metal rib thickness between the channels needs to be increased. FIG. 22 shows the metal rib thickness that needs to be changed with natural gas pressure in a representative repeating unit of a heat exchanger. The repeating unit employed in FIG. 22 reads from left to right: natural gas (NG), low pressure refrigerant (LPR), high pressure refrigerant (HPR), LPR, HPR, LPR, NG. The table below gives the values of the metal thickness required at different natural gas pressures. The metal is stainless steel 304.

TABLE 1

Metal rib thickness at different natural gas pressures

| Natural Gas pressure (psig) | $t_1$ (in) | $t_2$ (in) | $t_3$ (in) |
|---|---|---|---|
| 635 | .050 | .073 | .010 |
| 1000 | .064 | .094 | .017 |
| 1500 | .078 | .117 | .025 |
| 2000 | .091 | .138 | .034 |
| 2500 | .101 | .157 | .044 |

Figure 23:
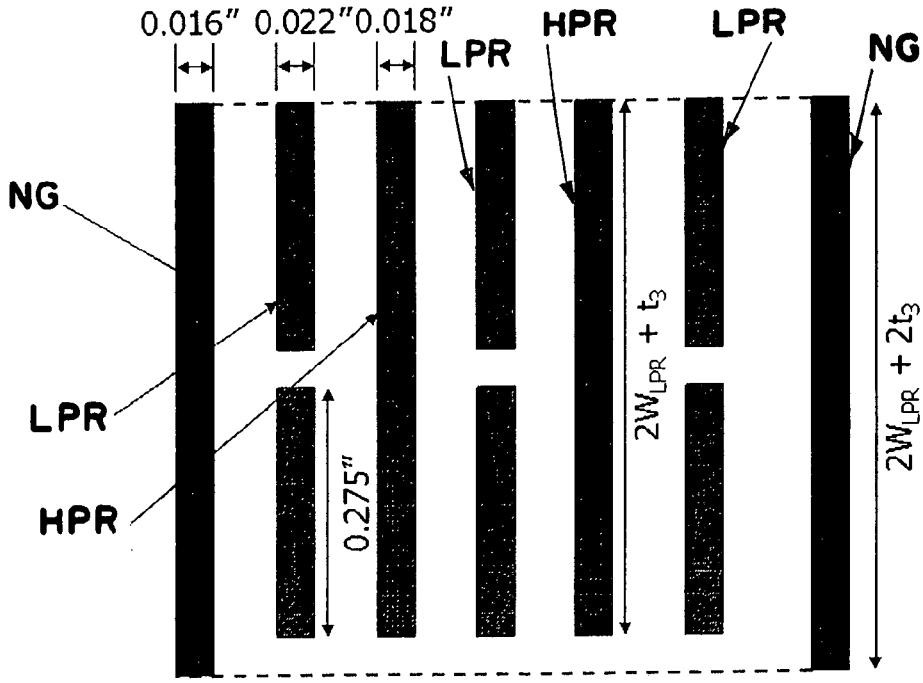

The other dimensions for the repeating unit illustrated in FIG. 22 are shown in FIG. 23. The width of the natural gas (NG) channel can extend to the entire width of the heat exchanger without any ribs between the channels. The input flow conditions that are not changed with natural gas pressure are:

1. Inlet temperature of natural gas, low pressure refrigerant and high pressure refrigerant.
2. Inlet pressure of low pressure refrigerant and high pressure refrigerant.
3. Mass flow rate of natural gas.

For a given natural gas pressure, the mass flow rate of the refrigerant is calculated to determine the outlet temperature. The outlet temperature of natural gas is −155.6° C. The table below summarizes the flow conditions.

TABLE 2

Summary of flow conditions

| | Natural Gas (NG) | Low Pressure Refrigerant (LPR) | High Pressure Refrigerant (HPR) |
|---|---|---|---|
| Inlet Temperature (° C.) | 32.2° C. | −158.3° C. | 29.5° C. |
| Inlet Pressure (psig) | Varied | 30 psig | 323.3 psig |
| Flow rate (kg/hr) | 7144.1 kg/hr | Varied | Varied |

Figure 24:
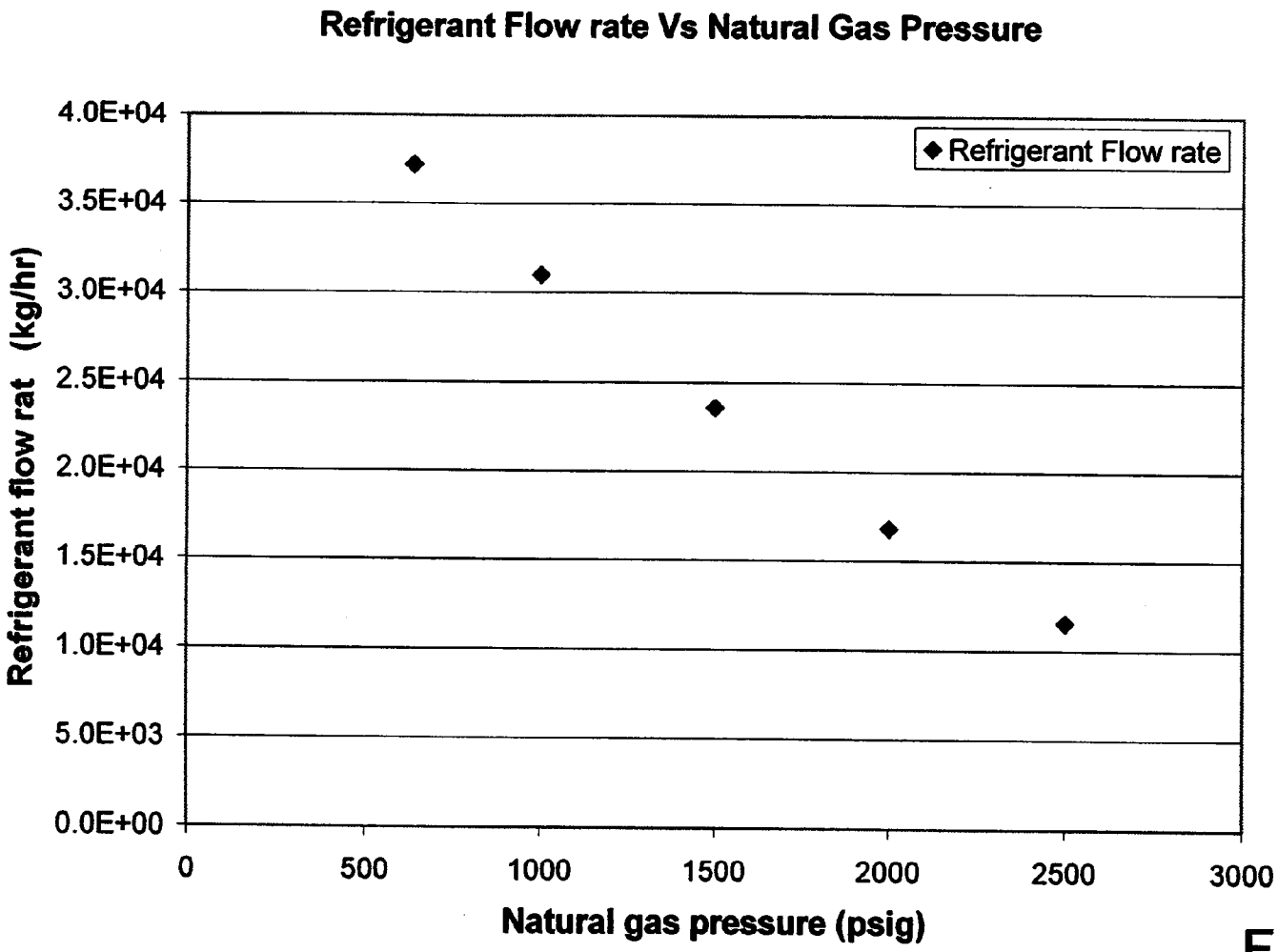
FIG. 24 is a graph showing refrigerant flow rate versus natural gas pressure.

The molar composition in percentages for the refrigerant is: Nitrogen: 0.1405; Methane: 0.3251; Ethylene: 0.3393; Propane: 0.1297; i-butane: 0.0244; and i-pentane: 0.0410. With a higher natural gas operating pressure, less refrigerant is required to cool natural gas to −155.6° C. The graph provided in FIG. 24 shows refrigerant flow rate required to cool natural gas at different natural gas pressures.

As the metal rib thickness increases with natural gas pressure, the heat loss due to axial conduction also increases. The average axial conduction in the metal rib between natural gas and low pressure refrigerant is calculated. Ratio, R is defined as:

$$R = \frac{\text{Heat Transferred in axial direction (flow direction)}}{\text{Heat transferred from Natural Gas to LPR}}$$

Figure 25:
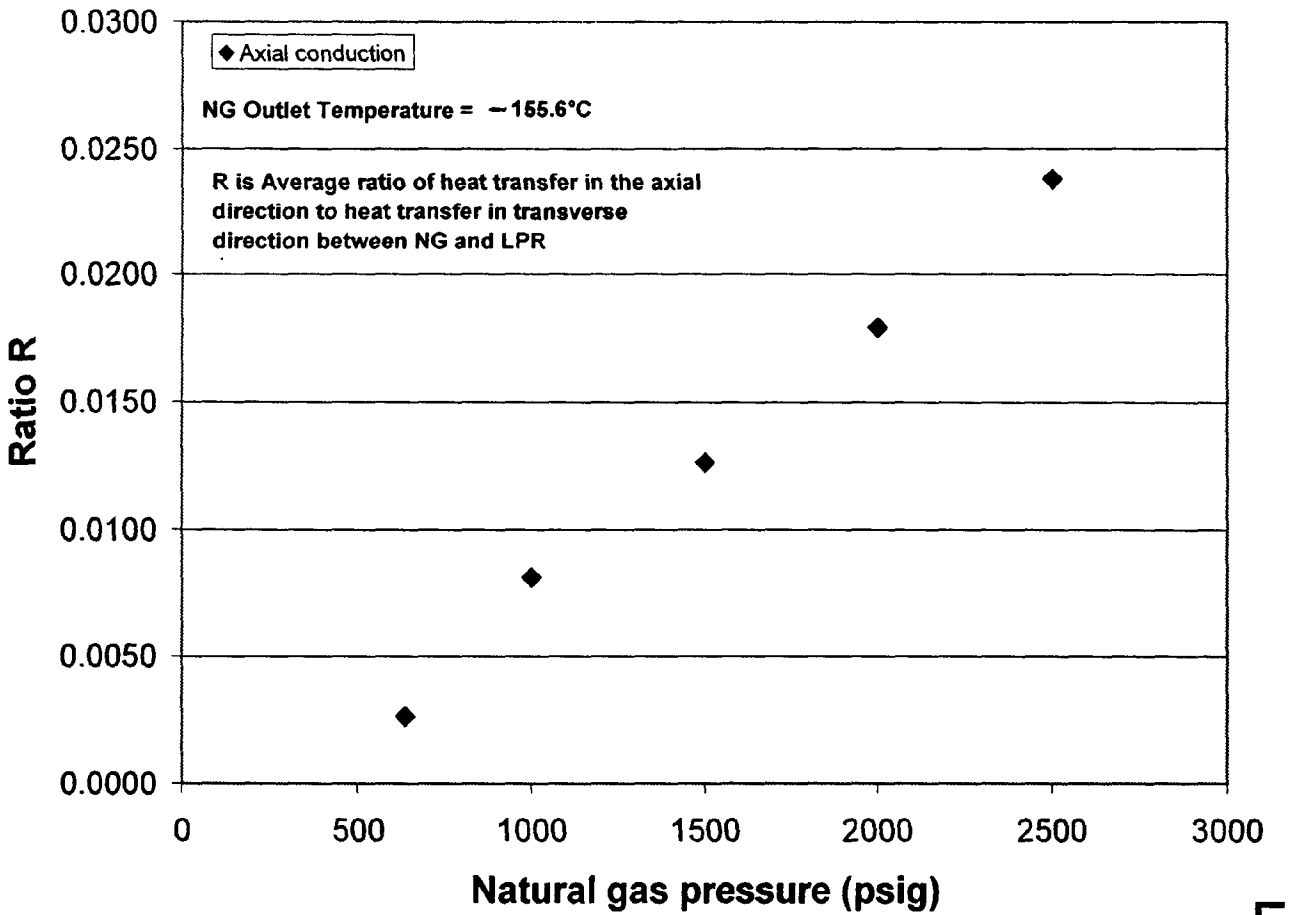
FIG. 25 is a graph showing heat transfer axial conduction versus natural gas pressure.

FIG. 25 shows the variation of axial conduction with natural gas pressure. Though the axial conduction increases with natural gas pressure, there is an overall benefit in terms of reducing total refrigerant flow rate. The loss in performance due to axial conduction is small compared to the gain in performance at higher natural gas pressure.

EXAMPLE 2

A three stream heat exchanger is provided for the purpose of liquefying natural gas. Two of the streams involve the flow of a refrigerant through the heat exchanger, and the third stream involves the flow of the natural gas. One of the refrigerant streams is a high pressure refrigerant stream which is operated at a pressure of 323.3–322.8 psig, and the other refrigerant stream is a low pressure refrigerant stream which is operated at a pressure of 29.95–27.75 psig. The high pressure and low pressure refrigerant streams flow counter current to each other as illustrated in FIG. 3 The natural gas stream flows cross current to the refrigerant streams as illustrated in FIG. 3.

The heat exchanger is constructed of stainless steel (SS 304). It has a length of 1.00 meter, a width of 1.70 meters, and a stacking height of 2.85 meters. The core volume for the heat exchanger is 4.85 cubic meters. Repeating units of microchannel layers corresponding to repeating unit 100 in FIG. 2 are used. The number of repeating units 100 used is 220.

The high pressure refrigerant flows through a set of first microchannels corresponding to microchannels 122 and 162 in FIG. 2. The heat exchanger has a total of 51,480 first microchannels operating in parallel. Each of the first microchannels 122 and 162 has a cross sectional shape in the form of rectangle. Each microchannel 122 and 162 has a width of 0.56 inch (14.22 mm), a height of 0.018 inch (0.45 mm) and a length of 3.28 ft (1.00 meter). The high pressure refrigerant entering the set of first microchannels is in the form of a mixture of liquid and vapor, while the high pressure refrigerant exiting the set of first microchannels is in the form of a liquid. The Reynolds Number for the liquid refrigerant flowing through the set of first microchannels is 99.7. The Reynolds Number for the vapor refrigerant flowing through set of first microchannels is 649.

The low pressure refrigerant flows through a set of second microchannels corresponding to microchannels 112, 132 and 152 in FIG. 2. The heat exchanger has a total of 155,100 second microchannels operating in parallel. Each of the microchannels 112, 132 and 152 has a cross sectional shape in the form of rectangle. Each microchannel has a width of 0.275 inch (6.99 mm), a height of 0.022 inch (0.59 mm) and a length of 3.28 feet (1.00 meter). The low pressure refrigerant entering the second microchannels is in the form of a mixture of liquid and vapor, while the low pressure refrigerant exiting the set of second microchannels is in the form of a vapor. The Reynolds Number for the liquid flowing through the set of second microchannels is 99. The Reynolds Number for the vapor flowing through set of second microchannels is 988.

The natural gas flows through a set of third microchannels corresponding to microchannel 142 in FIG. 2. The heat exchanger has 220 third microchannels operating in parallel. Each of the third microchannels has a cross sectional shape in the form of a rectangle. Each microchannel has a width of 5.58 feet (1.70 meters), a height of 0.016 inch (0.41 mm) and a length of 3.28 feet (1.0 meter). The natural gas is liquefied as it flows through the set of third microchannels. The Reynolds Number for the liquid flowing through the set of third microchannels is 99. The Reynolds Number for the gas flowing through set of third microchannels is 870.

Figure 26:
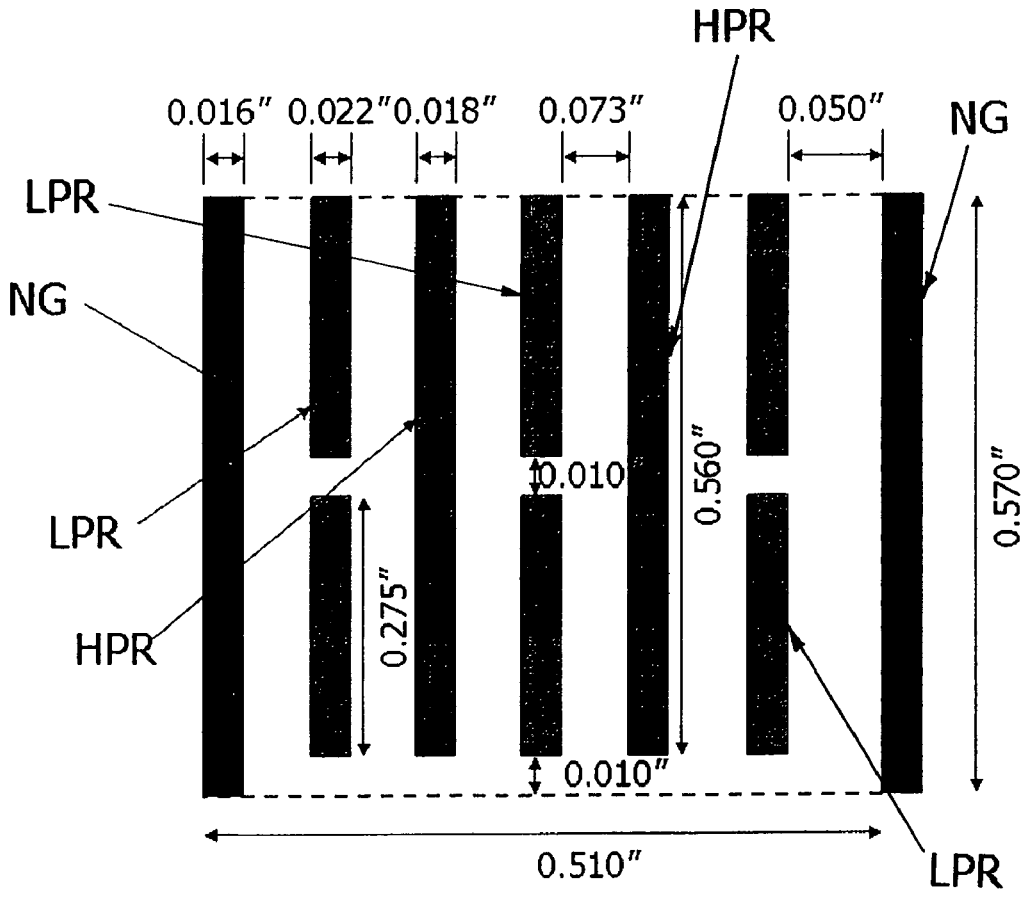
FIG. 26 is a schematic illustration showing the sequence of microchannels used in the heat exchanger described in Example 2.

The repeating unit for this heat exchanger is illustrated in FIG. 26. The sequence of channels is used in this repeating unit reads from left to right as follows: NG (natural gas), LPR (low pressure refrigerant), HPR (high pressure refrigerant), LPR, HPR, LPR and NG. All dimensions shown in FIG. 26 are inches. Though the representative repeating unit shows a width for the NG channel of 0.570 inch, it extends to the entire heat exchanger (5.58 feet). The IPHTAP for streams in the interior of the heat exchanger are different than the IPHTAP for streams at the periphery. Calculations of IPHTAP for interior channels are shown below:

$$IPHTAP_{interior,\,NG} = \frac{2\times5.58\times12}{2\times5.58\times12+2\times0.016}\times100 = 100\%$$

$$IPHTAP_{interior,\,LPR} = \frac{2\times0.275}{2\times0.275+2\times0.022}\times100 = 92.6\%$$

$$IPHTAP_{interior,\,HPR} = \frac{2\times0.560}{2\times0.560+2\times0.018}\times100 = 96.9\%$$

For channels located at the periphery, the IPHTAP for the different streams is:

$$IPHTAP_{periphery,\,NG} = \frac{5.58\times12}{2\times5.58\times12+2\times0.016}\times100 = 50\%$$

$$IPHTAP_{peripery,\,LPR} = \frac{2\times0.275}{2\times0.275+2\times0.022}\times100 = 92.6\%$$

$$IPHTAP_{peripehry,\,HPR} = \frac{2\times0.560}{2\times0.560+2\times0.018}\times100 = 96.9\%$$

The refrigerant has the following composition (all percentages being mol %):

| | |
|---|---|
| Nitrogen | 10% |
| Methane | 24% |
| Ethylene | 28% |
| Propane | 16% |
| Isobutane | 5% |
| Isopentane | 17% |

The refrigerant is compressed in a compressor to a pressure of 331.3 psig and a temperature of 153° C. The compressed refrigerant flows to a condenser where the pressure is reduced to 323.3 psig and the temperature is reduced to 29.4° C. At this point the refrigerant is a high pressure refrigerant in the form of a mixture of vapor and liquid. The refrigerant flows from the condenser and then to and through the set of first microchannels 122 and 162 in the heat exchanger. The total pressure drop for the refrigerant as it flows through the set of first microchannels is 0.3 psi. The refrigerant leaving the set of first microchannels is at a pressure of 322.8 psig and a temperature of −153.9° C. The refrigerant then flows through an expansion valve where the pressure drops to 29.95 psig and the temperature drops to −158.3° C. At this point the refrigerant is a low pressure refrigerant. From the expansion valve the refrigerant flows through the set of second microchannels 112, 132 and 152 in the heat exchanger. The total pressure drop for the refrigerant as it flows through the set of second microchannels is between 0.2–2.0 psi. The refrigerant exiting the set of second microchannels is at a pressure of 27.75 psig and a temperature of 20.9° C. The refrigerant then flows from the set of second microchannels back to the compressor where the refrigeration cycle starts again.

Natural gas at a pressure of 635.3 psig and a temperature of 32.2° C. enters the set of third microchannels in the heat exchanger. The natural gas flows through the set of third microchannels and exits the microchannels in the form of a liquid. The flow rate of the natural gas is 15,750 pounds per hour. The liquefied natural gas is at a pressure of 5 psig and a temperature of −155.3° C.

Figure 4:
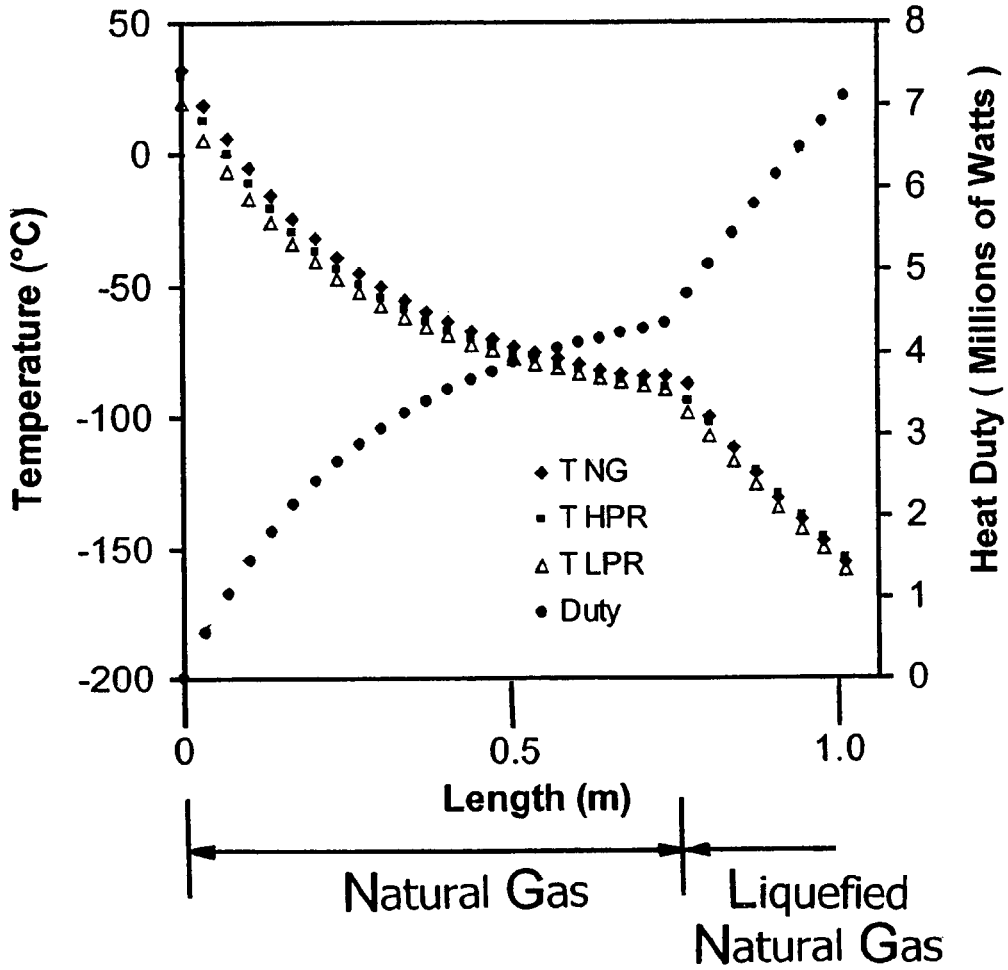
FIG. 4 is a plot showing the temperature of the three streams in the heat exchanger of Example 2 and the total heat transferred in the heat exchanger.

The volumetric heat flux for the heat exchanger is 1.5 $W/cm^3$. A plot of the temperature of the three streams in the heat exchanger and the total heat transferred in the heat exchanger is provided in FIG. 4. In FIG. 4, TNG refers to the temperature of the natural gas. THPR refers to the temperature of the high pressure refrigerant. TLPR refers to the temperature of the low pressure refrigerant. Heat duty in FIG. 4 refers to the accumulative heat transfer amount counted from the hot end.

While the invention has been explained in relation to various detailed embodiments, it is to be understood that various modifications thereof will become apparent to those skilled in the art upon reading the specification. Therefore, it is to be understood that the invention disclosed herein is intended to cover such modifications as fall within the scope of the appended claims.

The invention claimed is:

1. A process for cooling a fluid product in a heat exchanger, the process comprising:

compressing a fluid refrigerant, expanding the fluid refrigerant and flowing the fluid refrigerant through a set of refrigerant microchannels in the heat exchanger; and flowing the product through a set of product microchannels in the heat exchanger;

the product flowing through the product microchannels exchanging heat with the refrigerant flowing through the refrigerant microchannels, the product exiting the set of product microchannels being at a temperature in the range from about −250° C. to about 500° C. and being cooler than the product entering the set of product microchannels.

2. The process of claim 1 wherein the heat exchanger is a two-stream heat exchanger.

3. The process of claim 1 wherein the heat exchanger is a three-stream heat exchanger.

4. The process of claim 1 wherein the heat exchanger is a multi-stream heat exchanger employing more than three streams.

5. The process of claim 1 wherein the refrigerant flowing through the refrigerant microchannels comprises a refrigerant flowing through a set of first microchannels in the heat exchanger and another refrigerant flowing through a set of second microchannels in the heat exchanger, the refrigerant flowing through the set of second microchannels having a different composition and/or being at a different temperature and/or pressure than the refrigerant flowing through the set of first microchannels.

6. The process of claim 1 wherein the flow of refrigerant through the refrigerant microchannels is non-turbulent.

7. The process of claim 1 wherein the refrigerant entering the refrigerant microchannels is at a pressure of up to about 2000 psig and a temperature of about −180 to about 100° C.

8. The process of claim 1 wherein the refrigerant exiting the refrigerant microchannels is at a pressure of up to about 2000 psig and a temperature of about −180 to about 100° C.

9. The process of claim 1 wherein the product entering the product microchannels is at a pressure of up to about 5000 psig and a temperature of about −40 to about 40° C.

10. The process of claim 1 wherein the product exiting the product microchannels is at a pressure of up to about 5000 psig, and a temperature of about −170 to about −85° C.

11. The process of claim 1 wherein the product flowing through the product microchannels is at a pressure in the range of about 500 to about 5000 psig.

12. The process of claim 1 wherein the pressure drop for the refrigerant flowing through the refrigerant microchannels is up to about 30 psi/ft.

13. The process of claim 1 wherein the product microchannels are adjacent to the refrigerant microchannels.

14. The process of claim 1 wherein the flow of refrigerant through the refrigerant microchannels is countercurrent relative to the flow of product through the product microchannels.

15. The process of claim 1 wherein the flow of refrigerant through the refrigerant microchannels is cross-current relative to the flow of product through the product microchannels.

16. The process of claim 1 wherein the flow of refrigerant through the refrigerant microchannels is co-current relative to the flow of product through the product microchannels.

17. The process of claim 5 wherein the refrigerant entering the set of first microchannels comprises a single phase vapor, a single phase liquid, or a mixture of vapor and liquid, the Reynolds Number for the flow of vapor refrigerant through the set of first microchannels being up to about 100,000 and the Reynolds Number for the flow of liquid refrigerant through the set of first microchannels being up to about 10,000.

18. The process of claim 5 wherein the refrigerant entering the set of second microchannels comprises a mixture of vapor and liquid, the Reynolds Number for the flow of vapor refrigerant through the set of second microchannels being up to about 4000, and the Reynolds Number for the flow of liquid refrigerant through the set of second microchannels being up to about 4000.

19. The process of claim 1 wherein the refrigerant is compressed in a compressor and then cooled prior to flowing through the refrigerant microchannels.

20. The process of claim 5 wherein the refrigerant flows from the set of first microchannels through an expansion device to the set of second microchannels.

21. The process of claim 5 wherein the flow of refrigerant through the set of first microchannels is countercurrent relative to the flow of refrigerant through the set of second microchannels.

22. The process of claim 5 wherein the flow of refrigerant through the set of first microchannels is cocurrent relative to the flow of refrigerant through the set of second microchannels.

23. The process of claim 5 wherein the flow of refrigerant through the set of first microchannels is cross-current relative to the flow of refrigerant through the set of second microchannels.

24. The process of claim 5 wherein the refrigerant entering the set of first microchannels is at a pressure of up to about 2000 psig and a temperature of about −50 to about 100° C.

25. The process of claim 5 wherein the refrigerant exiting the set of first microchannels is at a pressure of up to about 2000 psig and a temperature of about −180 to about 900° C.

26. The process of claim 5 wherein the refrigerant entering the set of second microchannels is at a pressure of up to about 1000 psig and a temperature of about −180 to about −90° C.

27. The process of claim 5 wherein the refrigerant exiting the set of second microchannels is at a pressure of up to about 1000 psig and a temperature of about −50 to about 100° C.

28. The process of claim 5 wherein the product entering the set of third microchannels is at a pressure of up to about 5000 psig and a temperature of about −40 to about 40° C.

29. The process of claim 5 wherein the product exiting the set of third microchannels is at a pressure of up to about 5000 psig, and a temperature of about −170 to about −85° C.

30. The process of claim 5 wherein the pressure drop for the refrigerant flowing through the set of first microchannels is up to about 30 psi/ft, and the pressure drop for the refrigerant flowing through the set of second microchannels is up to about 30 psi/ft.

31. The process of claim 1 wherein the refrigerant comprises nitrogen, carbon dioxide, an organic compound containing 1 to about 5 carbon atoms per molecule, or a mixture of two or more thereof.

32. The process of claim 1 wherein the product comprises carbon dioxide, helium, nitrogen, argon, an organic compound containing 1 to about 5 carbon atoms per molecule, or a mixture of two or more thereof.

33. The process of claim 1 wherein the product entering the product microchannels comprises natural gas.

34. The process of claim 1 wherein the product exiting the product microchannels comprises liquefied natural gas.

35. The process of claim 1 wherein the product microchannels and refrigerant microchannels are constructed of a material comprising metal, ceramics, plastic, or a combination thereof.

36. The process of claim 1 wherein the refrigerant microchannels have internal dimensions of height of up to about 2 mm.

37. The process of claim 1 wherein the product microchannels have internal dimensions of height of up to about 2 mm.

38. The process of claim 1 wherein the refrigerant microchannels have lengths of up to about 10 meters.

39. The process of claim 1 wherein the product microchannels have lengths of up to about 10 meters.

40. The process of claim 1 wherein the coefficient of performance for the heat exchanger is at least about 0.5.

41. The process of claim 1 wherein the interstream planar heat transfer area percent for the refrigerant microchannels or the product microchannels is at least about 20%.

42. The process of claim 1 wherein the volumetric heat flux for the heat exchanger is at least about 0.5 $W/cm^3$.

43. The process of claim 1 wherein the effectiveness of the heat exchanger is at least about 0.8.

44. The process of claim 1 wherein the product is cooled from a temperature of about 40° C. to a temperature of about −160° C., the rate of flow of product through the heat exchanger being at least about 1500 pounds per hour per cubic meter of the core volume of the heat exchanger.

45. The process of claim 44 wherein the pressure drop for the flow of refrigerant through the refrigerant microchannels is up to about 30 psi.

46. The process of claim 1 wherein the approach temperature for the heat exchanger is up to about 50° C.

47. The process of claim 1 wherein the heat exchanger has a microchannel volume to heat exchanger volume ratio of at least about 0.2.

48. The process of claim 1 wherein micro-scale structures are formed on the interior surfaces of the refrigerant microchannels.

49. The process of claim 1 wherein the product exiting the product microchannels is advanced to another heat exchanger wherein the product is subjected to additional cooling, the another heat exchanger comprising another set of refrigerant microchannels and another set of product microchannels, another refrigerant flows through the another set of refrigerant microchannels, the product flows through the another set of product microchannels, the product flows through the another set of product microchannels exchanging heat with the another refrigerant flowing through the another set of refrigerant microchannels, the product exiting the another set of product microchannels being cooler than the product entering the another set of product microchannels.

50. The process of claim 49 wherein the product exiting the another set of product microchannels is advanced to a third heat exchanger wherein the product is subjected to additional cooling, the third heat exchanger comprising a third set of refrigerant microchannels and a third set of product microchannels, a third refrigerant flows through the third set of refrigerant microchannels, the product flows through the third set of product microchannels exchanging heat with the third refrigerant flowing through the third set of refrigerant microchannels, the product exiting the third set of product microchannels being cooler than the product entering the third set of product microchannels.

51. The process of claim 50 wherein the product is natural gas, the refrigerant is propane or propylene, the another refrigerant is ethane or ethylene, and the third refrigerant is methane.

52. The process of claim 1 wherein the product comprises natural gas, the natural gas flows through a series of microchannel heat exchangers to remove water, butanes or butylenes, propanes or propylene, and ethane or ethylene, from the natural gas prior to flowing the natural gas through the product microchannels.

53. The process of claim 1 wherein the walls of the product microchannels undergo a change in temperature of at least about 25° C. per meter of length of the product microchannels in the direction of flow of product through the product microchannels.

54. The process of claim 1 wherein the heat exchanger is equipped with two or more sub-manifolds for supplying refrigerant and product to the microchannels and removing refrigerant and product from the microchannels.

55. The process of claim 1 wherein the heat exchanger is equipped with a header at the entrance to the microchannels, the refrigerant is in the form of a mixture of vapor and liquid, the vapor and liquid being mixed in the header.

56. The process of claim 1 wherein the refrigerant is in the form of a mixture of vapor and liquid, the vapor and liquid being mixed in the microchannels.

57. The process of claim 1 wherein the refrigerant flowing through the refrigerant microchannels, the product flowing through the product microchannels, or both the refrigerant flowing through the refrigerant microchannels and the product flowing through the product microchannels are at a pressure of at least about 1500 psig.

58. The process of claim 1 wherein an additional heat exchanger is positioned upstream of the heat exchanger, the product flowing through the additional heat exchanger prior to flowing through the product microchannels in the heat exchanger.

59. The process of claim 1 wherein an additional heat exchanger is positioned downstream of the heat exchanger, the product flows through the product microchannels in the heat exchanger and then flows through the additional heat exchanger.

60. The process of claim 49 wherein an additional heat exchanger is positioned between the heat exchanger and the another heat exchanger, the product flows through the product microchannels in the heat exchanger, then flows through the additional heat exchanger, and then flows through the another set of product microchannels in the another heat exchanger.

61. A process for cooling a fluid product in a heat exchanger, the process comprising:

flowing a fluid refrigerant through a set of refrigerant microchannels in the heat exchanger, the refrigerant microchannels having lengths in the range from about 0.5 to about 10 meters; and flowing the product through a set of product microchannels in the heat exchanger, the product microchannels having lengths in the range from about 0.5 to about 10 meters;

the product flowing through the product microchannels exchanging heat with the refrigerant flowing through the refrigerant microchannels, the product exiting the set of product microchannels being at a temperature in the range from about −250° C. to about 500° C. and being cooler than the product entering the set of product microchannels.

62. A process for cooling a fluid product in a heat exchanger, the process comprising:

flowing a fluid refrigerant through a set of refrigerant microchannels in the heat exchanger; and flowing the product through a set of product microchannels in the heat exchanger;

the product flowing through the product microchannels exchanging heat with the refrigerant flowing through the refrigerant microchannels, the product exiting the set of product microchannels being cooler than the product entering the set of product microchannels;

the heat exchanger being equipped with a header at the entrance to the microchannels, the refrigerant being in the form of a mixture of vapor and liquid as it enters the refrigerant microchannels, the vapor and liquid being mixed in the header.

63. A process for cooling a fluid product in a heat exchanger, the process comprising:

flowing a fluid refrigerant through a set of refrigerant microchannels in the heat exchanger, the refrigerant being in the form of a mixture of vapor and liquid, the vapor and liquid being mixed in the refrigerant microchannels; and flowing the product through a set of product microchannels in the heat exchanger;

the product flowing through the product microchannels exchanging heat with the refrigerant flowing through the refrigerant microchannels, the product exiting the set of product microchannels being cooler than the product entering the set of product microchannels.

* * * * *